US005860518A

United States Patent [19]

Axelrod

[11] Patent Number: 5,860,518

[45] Date of Patent: Jan. 19, 1999

[54] ARTIST'S PASTEL CASE AND COLOR ARRANGEMENT

[76] Inventor: Dale Axelrod, 522 E. D St., Petaluma, Calif. 94952-3212

[21] Appl. No.: 826,481

[22] Filed: Mar. 27, 1997

[51] Int. Cl.[6] ..... A45C 11/34

[52] U.S. Cl. ..... 206/224; 206/1.7

[58] Field of Search ..... 434/84, 98, 103; 206/1.7, 1.8, 1.9, 224

[56] References Cited

U.S. PATENT DOCUMENTS

| | | | |
|---|---|---|---|
| 424,603 | 4/1890 | Favor | 206/1.7 |
| 824,374 | 6/1906 | Munsell | 434/98 |
| 918,068 | 4/1909 | Maratta | 434/98 |
| 1,217,283 | 2/1917 | Daniel et al. | 206/443 |
| 1,617,024 | 2/1927 | Munsell | 434/98 |

(List continued on next page.)

OTHER PUBLICATIONS

Sloan, John. *Gist of Art*. New York: Dover, 1977 (Reprint of 1939 edition) : pp. 119–121.

Sunset Books, Editors of. *Picture Framing & Wall Display*. Menlo Park: Lane Publishing, 1979 : p. 54.

Binney & Smith ( Easton, PA), *How to Mix and Use Color with the Liquitex® Color Map and Mixing Guide*, 1983: p. 22.

Flambeau Products Corp (Middlefield, OH), 1984, sales sheet for ArtBin® Pastel 3 pastel box.

*Daniel Smith Mail Order Catalog of Artist's Materials*, 1986, p. 24, showing pastel boxes and field carrier.

Aggett, Lionel. *Pastel Techniques*. Wiltshire, Great Britain: Crowood Press, 1992: p. 40.

*Daniel Smith Mail Order Catalog of Artist's Materials*, 1995, p. 24, showing pastel storage drawers.

*American Artist Magazine*, Dec. 1995, p. 16, showing a pastel container called *Lynch's Clean Pastel Palette*.

Sennelier (Paris), Pastel manufacturer's product brochure showing boxed pastel assortments, 1996.

*World Book Encyclopedia*, Chicago: Field Enterprises Educational, 1961: article entitled "TYPE" p. 441.

Johnson, Peter, edited by. *Painting With Pastels*. Cincinnati: North Light Books, 1984: pp. 127–128.

Flattman, Alan. *The Art of Pastel Painting*. New York: Watson–Guptill, 1987: p. 16.

Fractal Design (Aptos, CA), software publisher's brochure for educational paint program, 1995.

Royal Talens B.V. (Holland), pastel manufacturer's product brochure, and catalogue page offering empty pastel box, 1996–97. (Photographs attached.)

*Primary Examiner*—Jacob K. Ackun

[57] ABSTRACT

An artist's compartmented pastel case (50) and color arrangement for organizing, transporting, storing, and accessing artists' pastels, for use with computer graphics applications, and databases, as well as for use with traditional methods of painting with pastels. The case has a lid (60) which contains a removable resilient liner or pad (70) which protectively cushions and immobilizes pastels when the case is closed for transport. The color compartment arrangement (100) translates the painter's color triangle into a rectangular format by placing the three primary colors, red, yellow, and blue, in analogous locations (FIGS. 5 and 6). An empty, central compartment or current palette area (120) is provided as a place where all colors in current use can be grouped together. Empty subcompartments or holding areas (122), one located within each color compartment (FIG. 13), are also provided to hold selected pastels (172). The case's two-level construction keeps its color compartments free of dust and debris. A top layer of alignment elements on a mesh-like support grid (140) positions pastels within each color compartment, and allows pastel dust and fragments to fall into a collection chamber below. A color chart, disposed on the interior surface (130) of the lid, and viewed by removing the resilient pad, can be labeled and used to select pastel colors that have been calibrated with colors displayed on-screen in computer graphics, tutorial, or database applications (FIG. 28).

20 Claims, 13 Drawing Sheets

U.S. PATENT DOCUMENTS

| | | | |
|---|---|---|---|
| 1,747,486 | 2/1930 | Ridgway | 434/98 |
| 1,805,520 | 5/1931 | Grumbacher | 434/98 |
| 1,957,816 | 5/1934 | Braeg | 434/98 |
| 2,228,493 | 1/1941 | Will | 206/214 |
| 2,633,656 | 4/1953 | Digemma | 206/1.7 |
| 2,712,189 | 7/1955 | Grossman | 211/60.1 |
| 2,744,349 | 5/1956 | Grossman | 434/84 |
| 2,825,150 | 3/1958 | Steiner | 434/84 |
| 3,421,679 | 1/1969 | Goldman | 206/523 |
| 3,628,260 | 12/1971 | Jacobson | 434/103 |
| 3,722,109 | 3/1973 | Jacobson | 434/103 |
| 3,777,414 | 12/1973 | Robinson | 434/103 |
| 3,815,265 | 6/1974 | Depauw | 434/103 |
| 3,849,911 | 11/1974 | Longenecker | 434/84 |
| 4,027,404 | 6/1977 | Brant | 434/103 |
| 4,129,213 | 12/1978 | Fleig | 206/575 |
| 4,249,318 | 2/1981 | Anderson | 434/103 |
| 4,337,046 | 6/1982 | Anderson | 434/103 |
| 4,616,748 | 10/1986 | Thomas et al. | 206/214 |
| 4,638,909 | 1/1987 | Ford | 206/1.7 |
| 4,822,118 | 4/1989 | Watkins | 312/244 |
| 4,852,725 | 8/1989 | Folsom | 206/1.7 |
| 5,014,850 | 5/1991 | Huff | 206/371 |
| 5,123,745 | 6/1992 | Augur | 356/421 |
| 5,141,438 | 8/1992 | Spector | 434/87 |
| 5,174,758 | 12/1992 | Abramson | 434/98 |
| 5,209,664 | 5/1993 | Wilcox | 434/103 |
| 5,234,108 | 8/1993 | Jorgensen | 206/575 |
| 5,257,721 | 11/1993 | Smith et al. | 206/1.7 X |
| 5,325,958 | 7/1994 | Arasim | 206/1.8 |
| 5,343,311 | 8/1994 | Morag et al. | 358/518 |
| 5,382,233 | 1/1995 | Brotz | 434/88 |
| 5,513,991 | 5/1996 | Reynolds et al. | 434/81 |
| 5,552,805 | 9/1996 | Alpher | 345/153 |

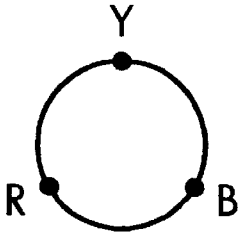
FIG 1-A
(PRIOR ART)
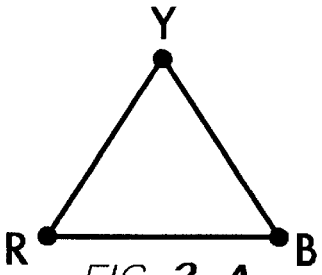
FIG 2-A
(PRIOR ART)
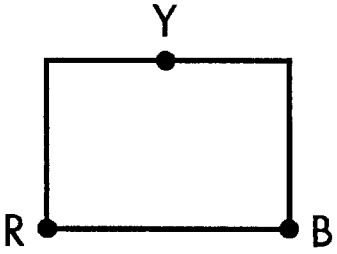
FIG 3
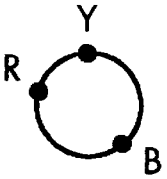
FIG 1-B
(PRIOR ART)
FIG 2-B
(PRIOR ART)
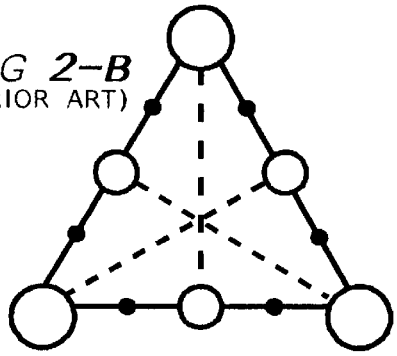
| | | | | | |
|---|---|---|---|---|---|
| | | | Y | | |
| R | | | | B | |
FIG 4
FIG 5
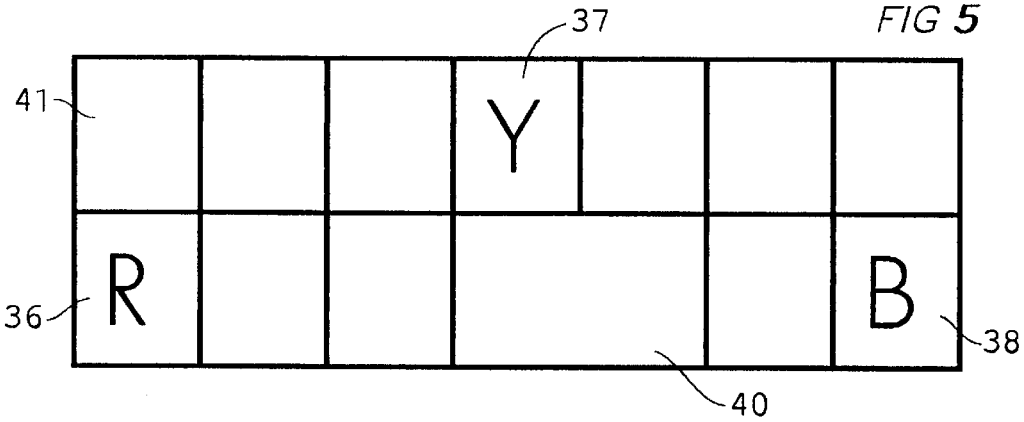
FIG 6
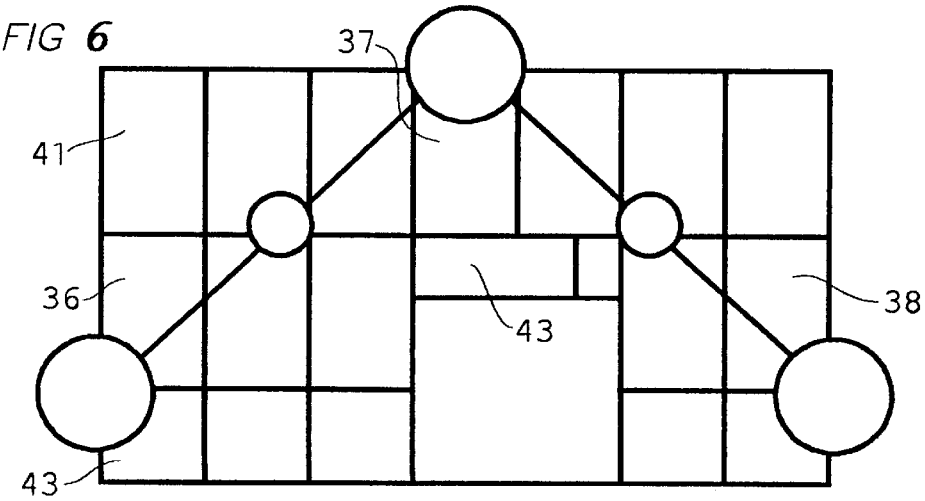

FIG 7
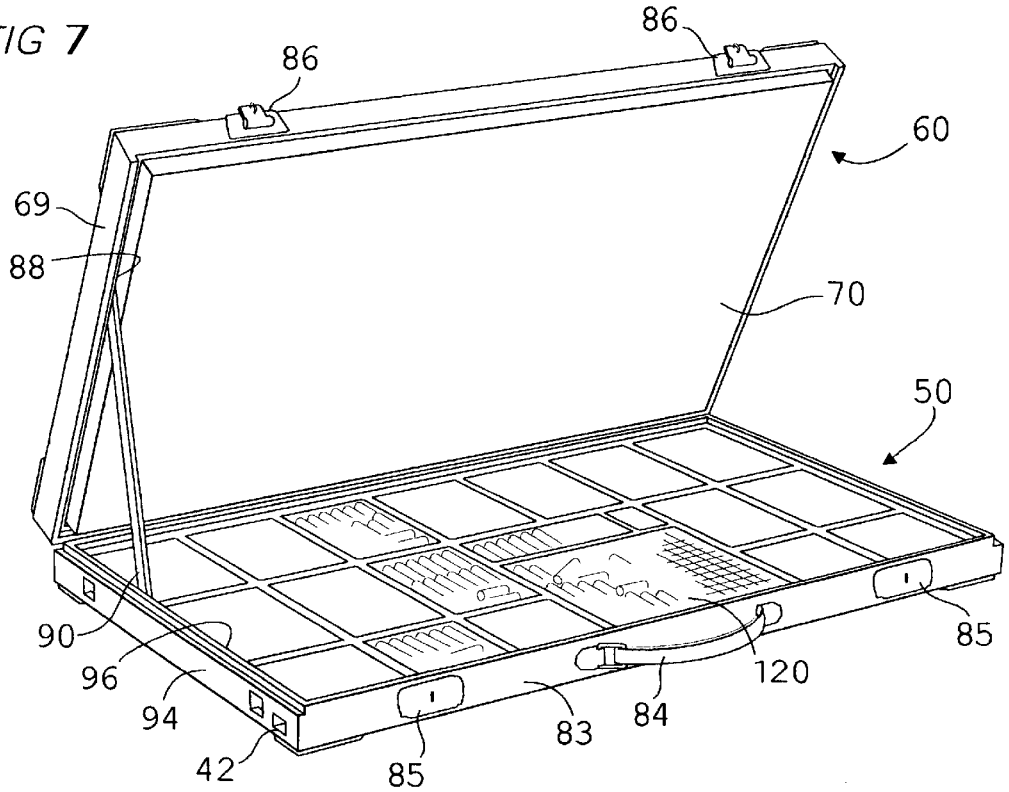
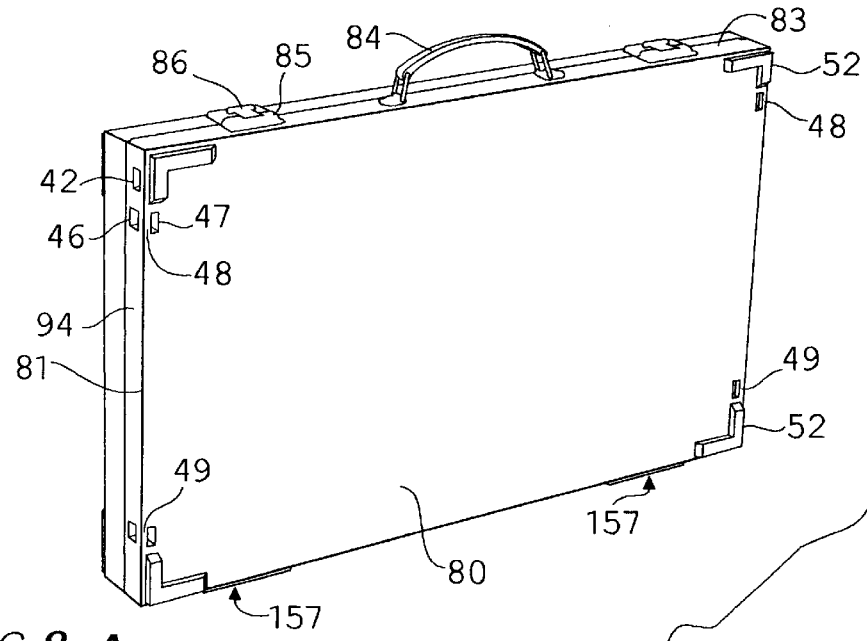
FIG 8-A
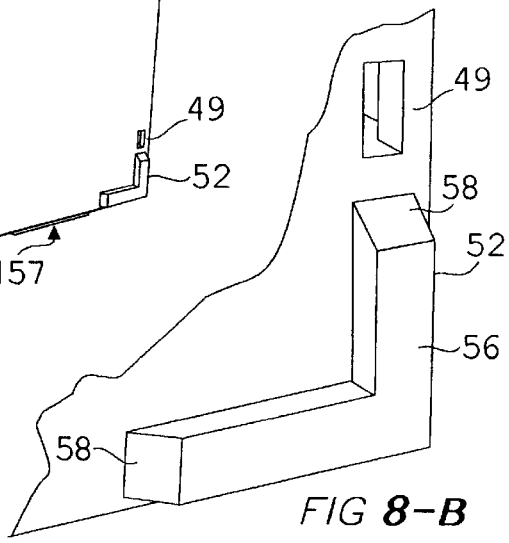
FIG 8-B

FIG 9-A
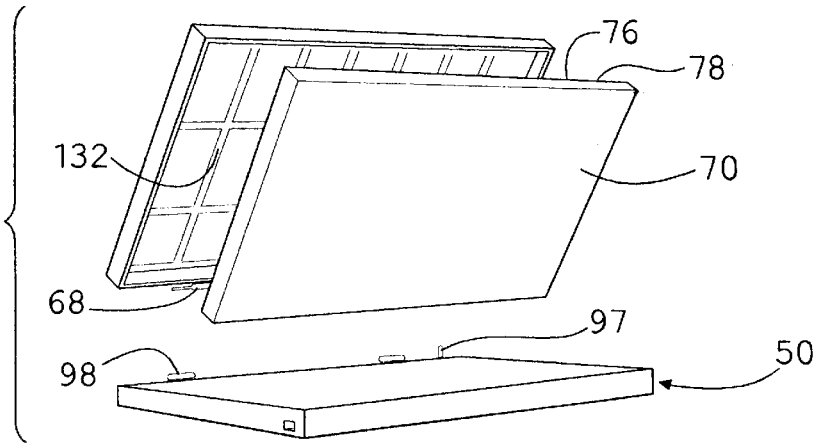
FIG 9-B
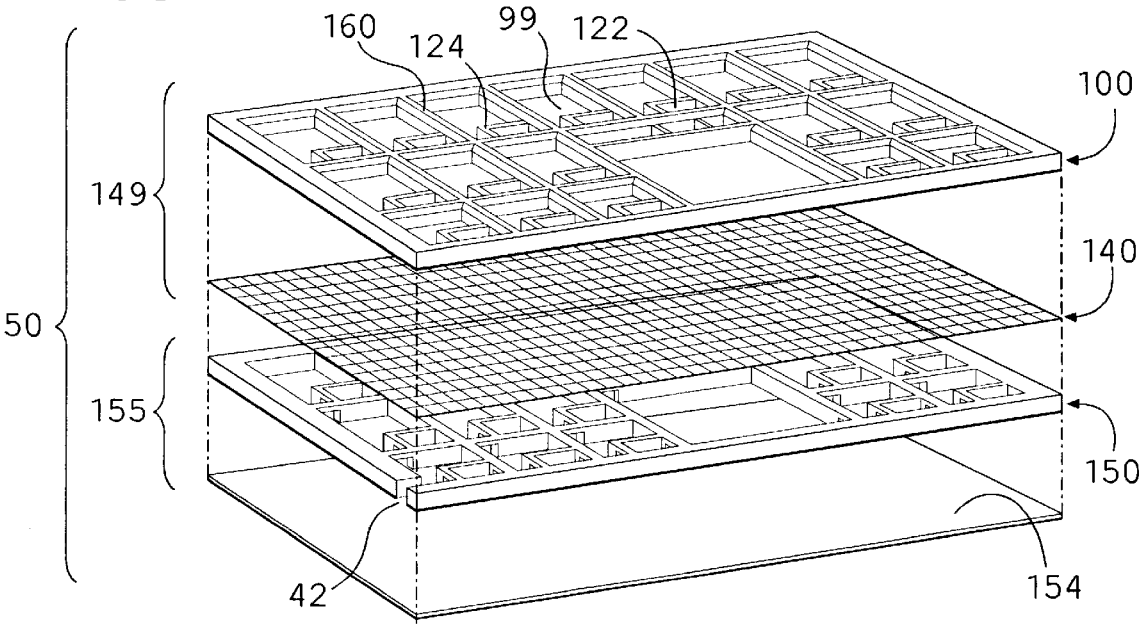
FIG 10-A
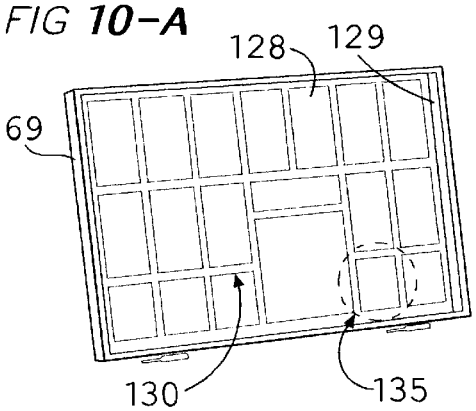
FIG 10-B
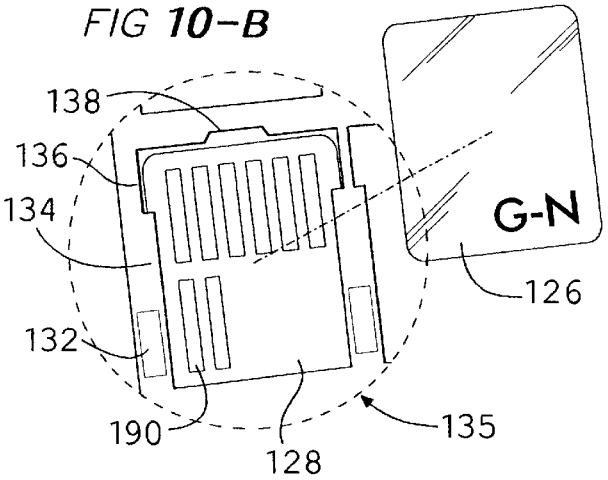

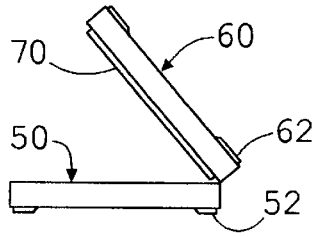
FIG 11-A
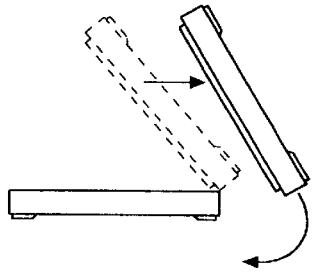
FIG 11-B
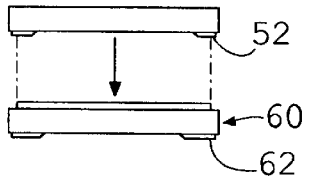
FIG 11-C
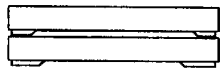
FIG 11-D
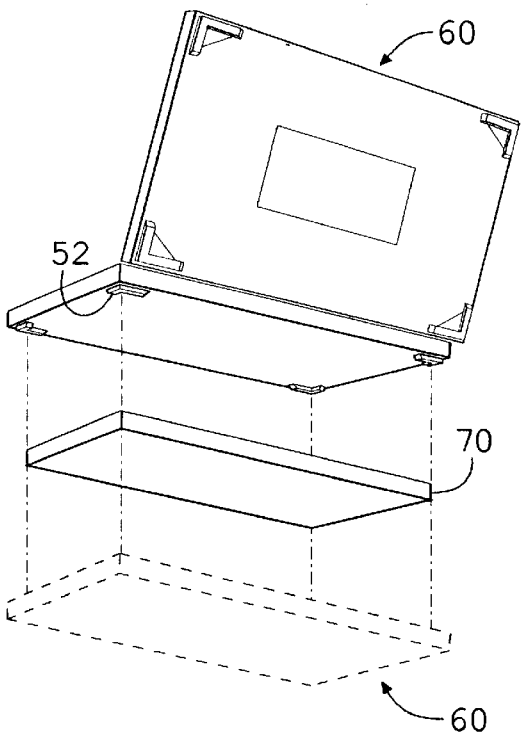
FIG 11-E
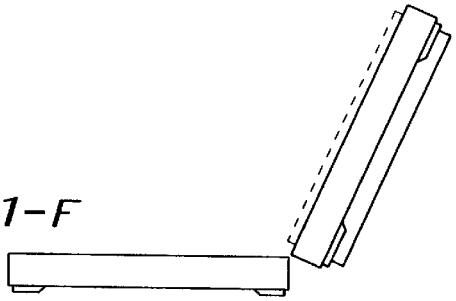
FIG 11-F
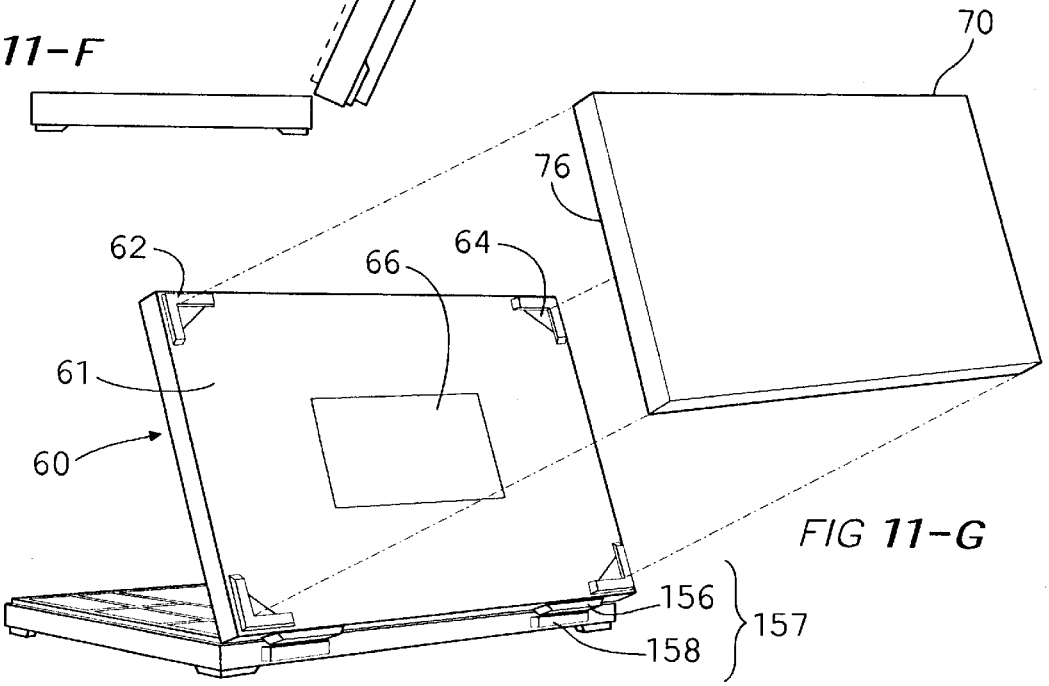
FIG 11-G FIG 12-A
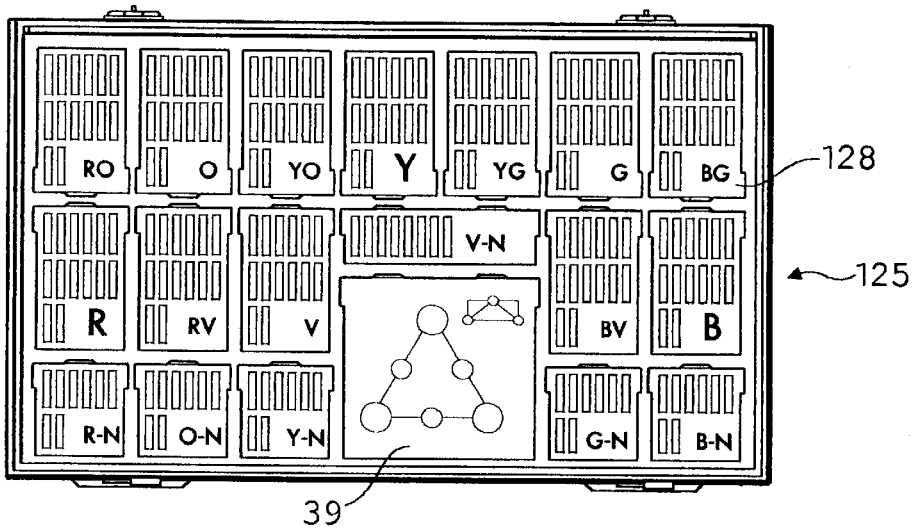
FIG 12-B
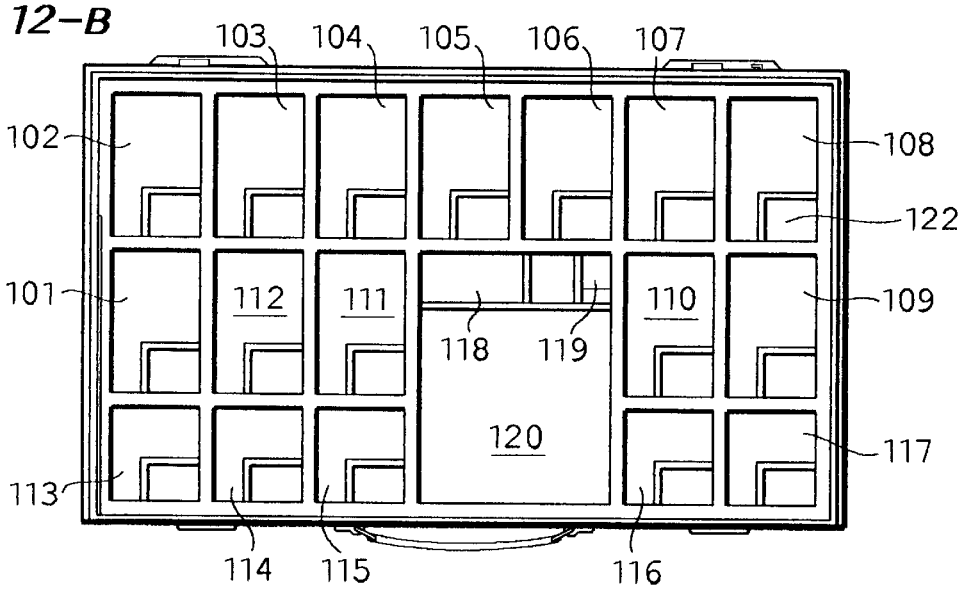
FIG 12-C
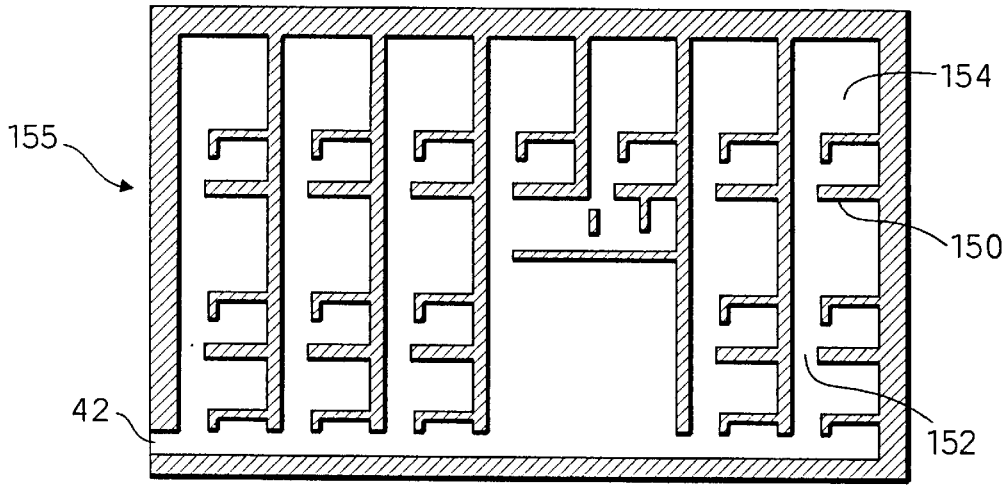

FIG 15-A
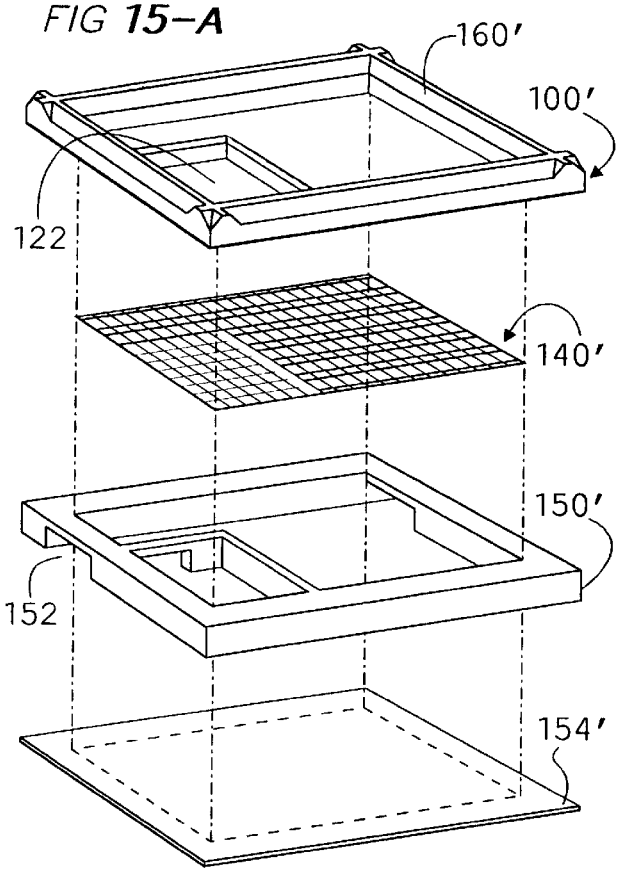
FIG 15-B
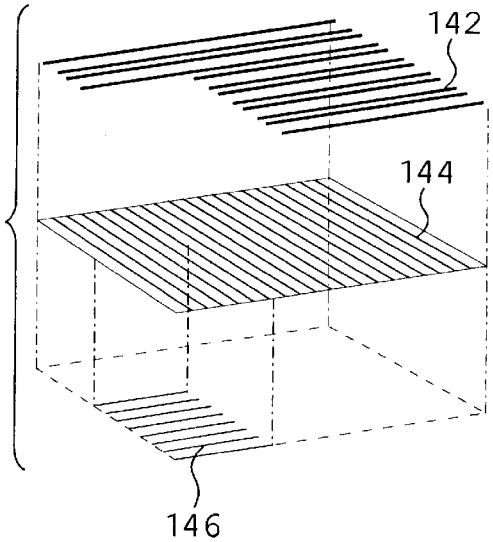
FIG 16
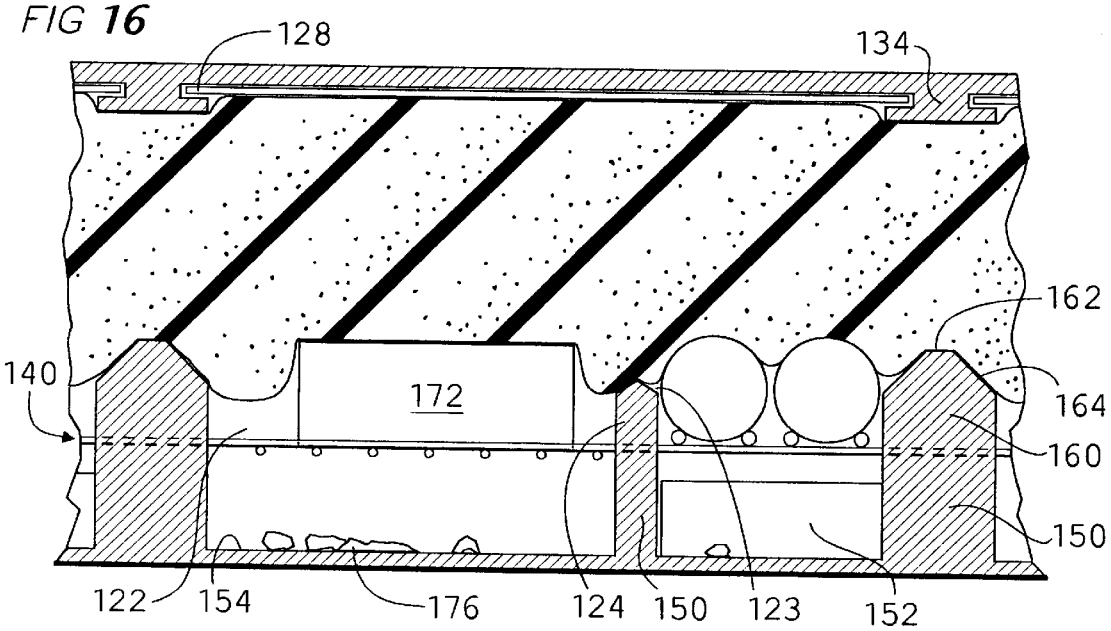

FIG 17-A
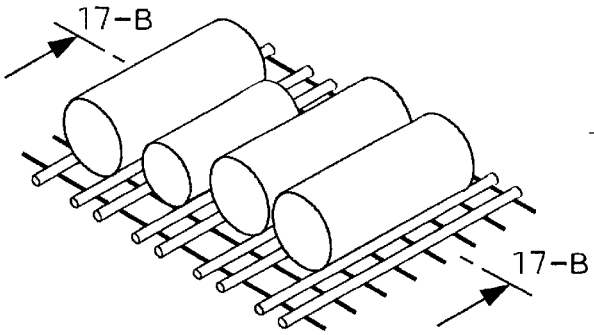
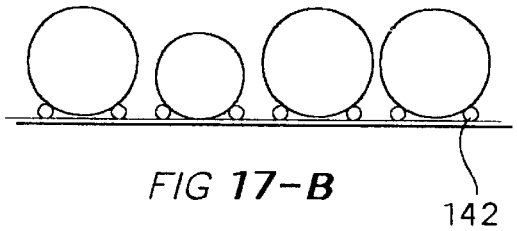
FIG 17-B
FIG 18-A
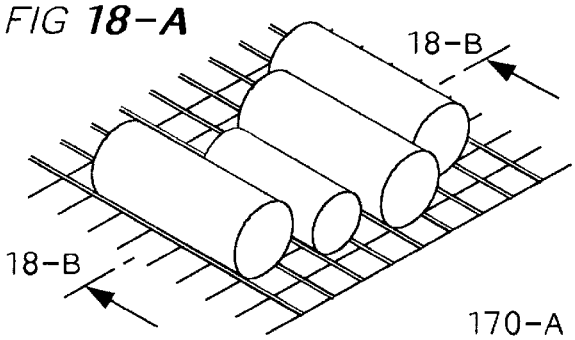
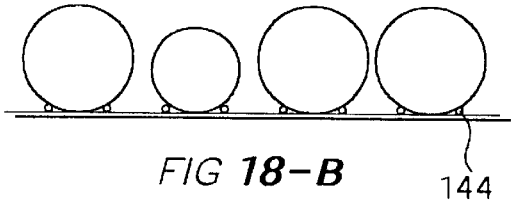
FIG 18-B
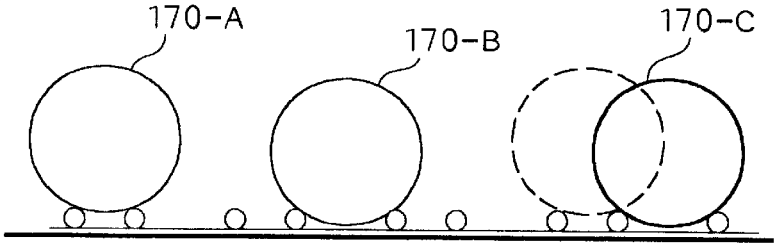
FIG 19
FIG 20
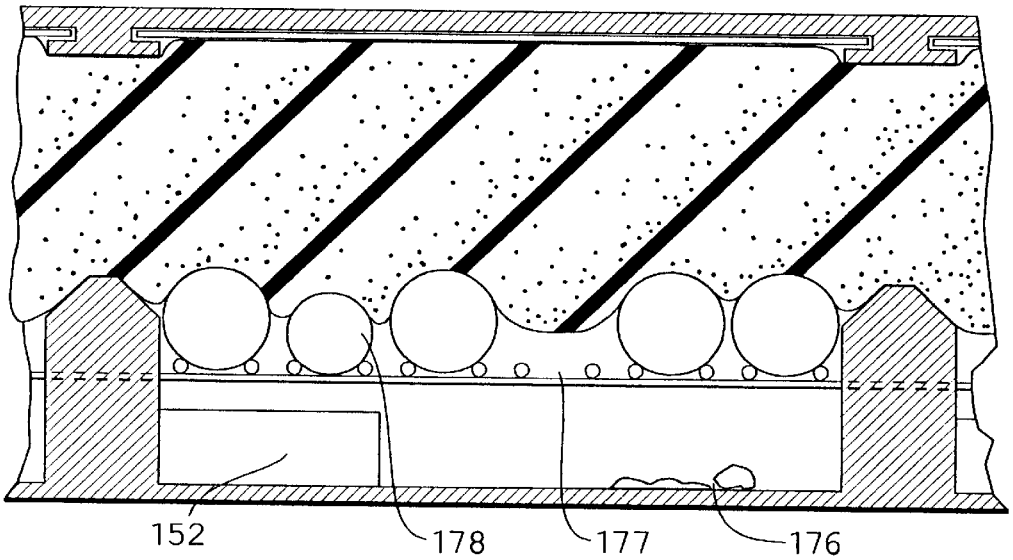

FIG 21
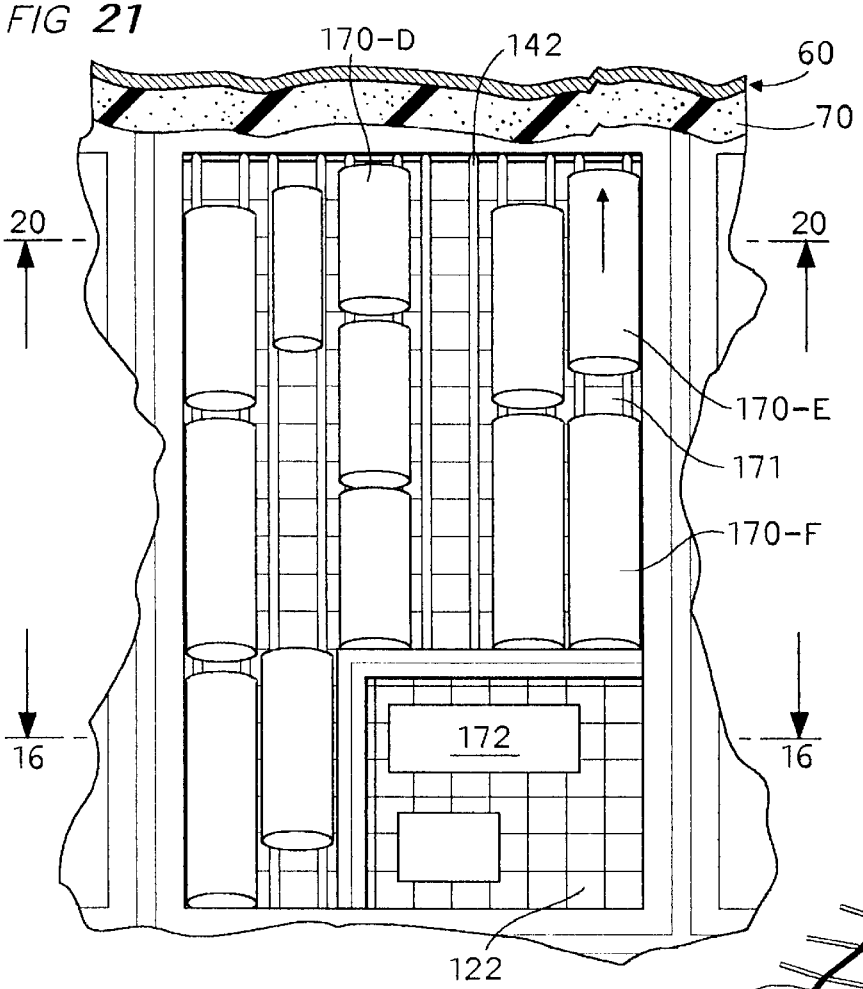
FIG 22-B
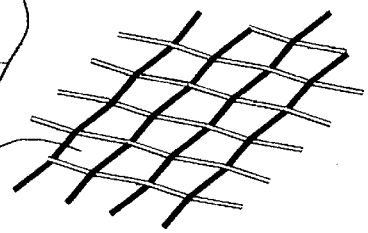
FIG 22-A
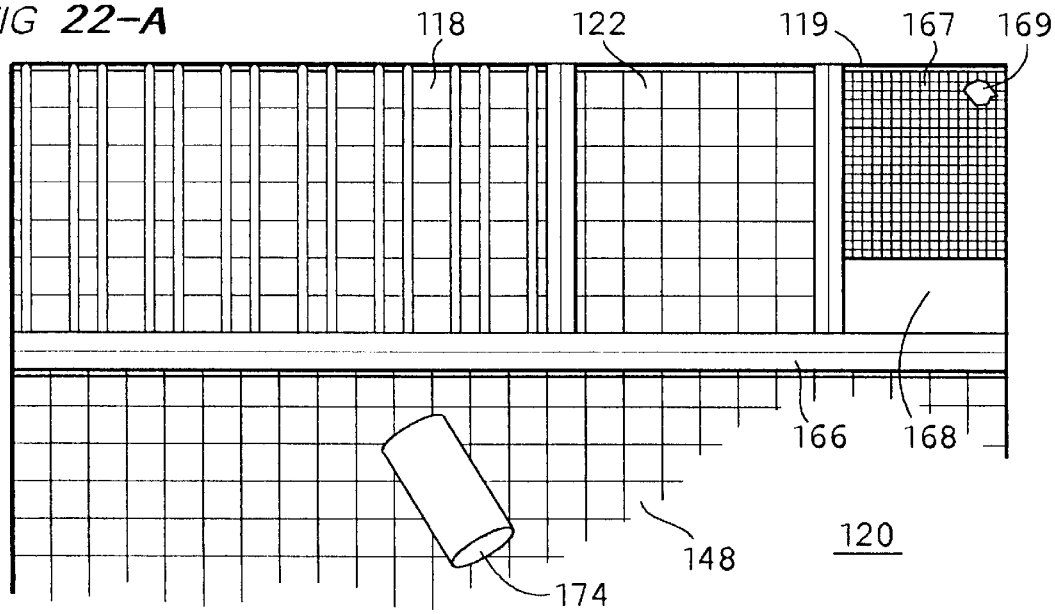

FIG 23-A
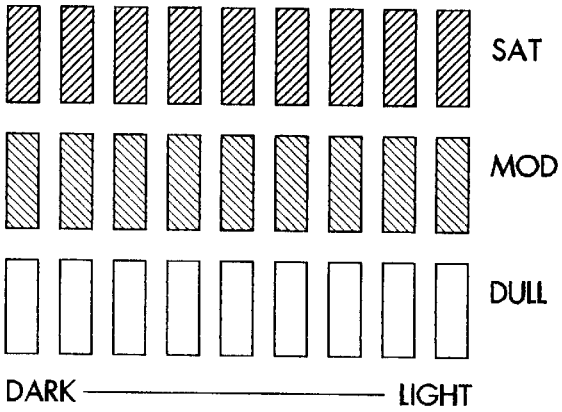
FIG 23-B
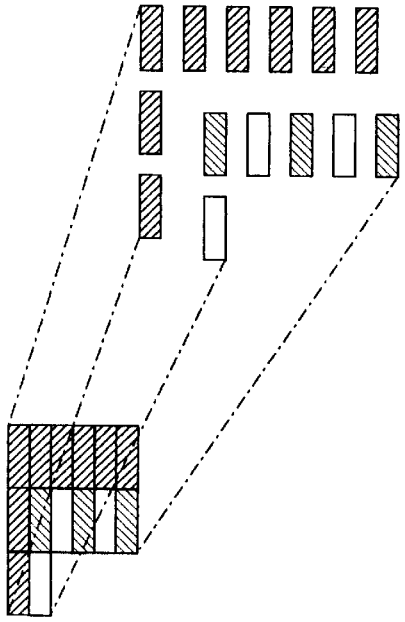
FIG 25
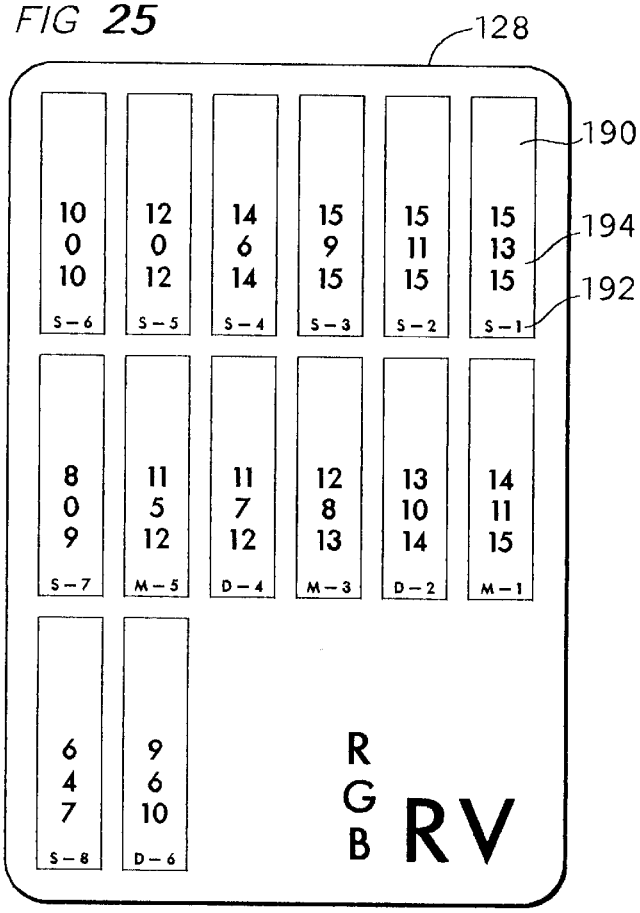
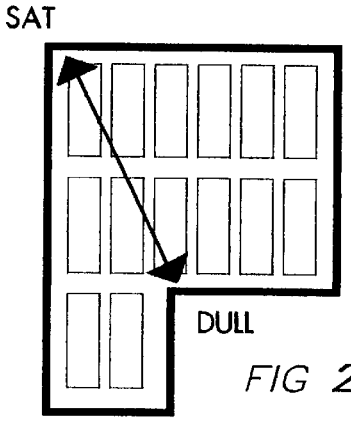
FIG 24-A
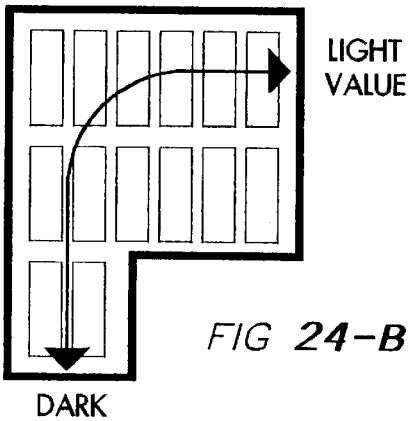
FIG 24-B FIG 29-A
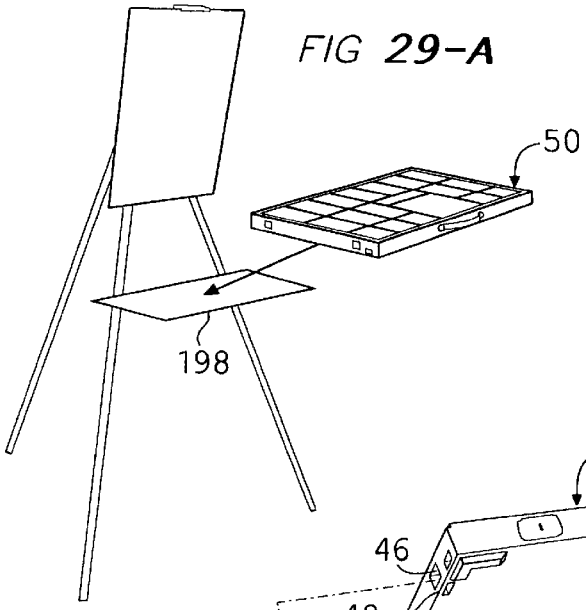
FIG 29-B
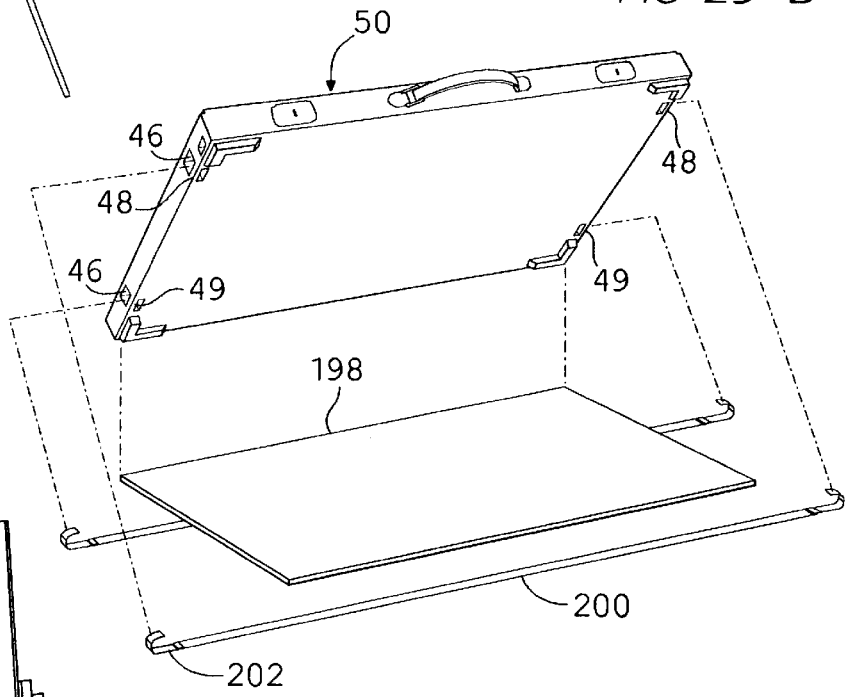
FIG 30
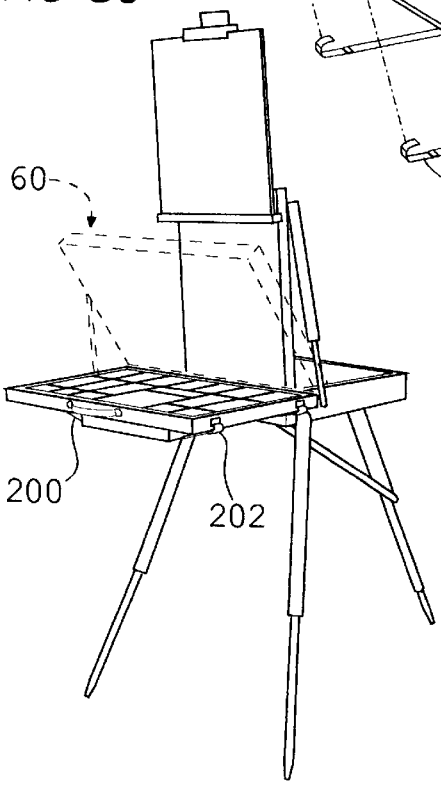
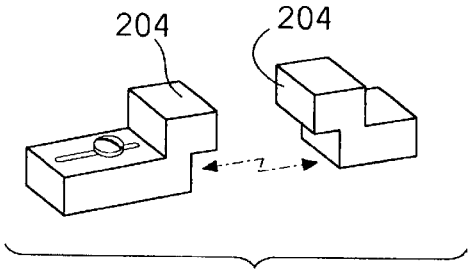
FIG 29-C

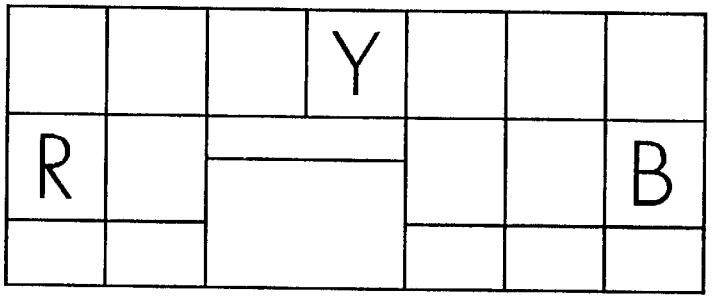
FIG 31-A
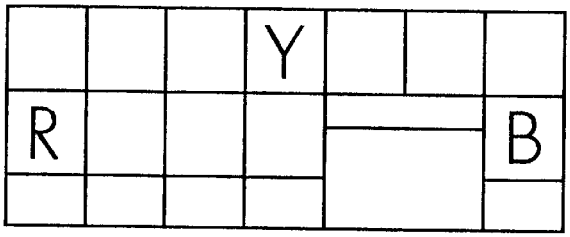
FIG 31-B
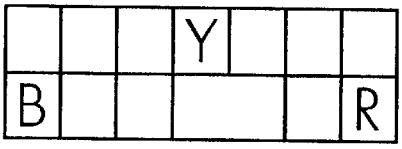
FIG 31-C
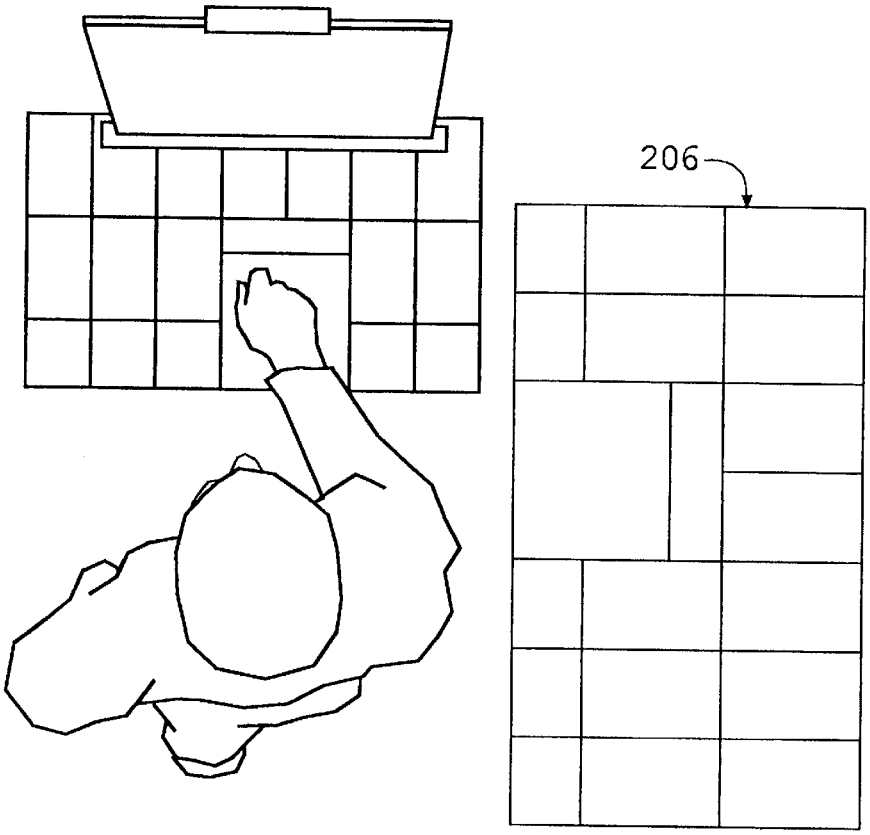
FIG 32

ARTIST'S PASTEL CASE AND COLOR ARRANGEMENT

BACKGROUND—FIELD OF INVENTION

This invention relates to artists' containers and palettes, specifically to a device for holding and arranging artists' pastels.

BACKGROUND—DESCRIPTION OF PRIOR ART

Pastels are high-quality artists' pigments formed into crayon-like sticks. They allow artists to apply color directly to a painting surface, without the need for brushes or solvents. Pastel is a wonderful painting medium for students and professionals because it can be employed rapidly. A color study is dry as soon as it is finished. Cleanup usually consists of washing one's hands.

Nevertheless, many artists, especially beginners, are kept from using pastels by the absence of a well-designed pastel container. The boxes in which pastel manufacturers package their color assortments do not have many of the features artists need. For instance, while painting, there is no place to set down colors currently in use. Artists must improvise a work area outside the box for this. Another problem is that the assortments are packaged in several stacking trays. Artists need to unpack these trays and find a support big enough on which to arrange them. A commercially-marketed pastel container, manufactured by Flambeau Products Corporation of Middlefield Ohio, is currently the most widely available alternative to the pastel manufacturers' boxes. It too comes with several component trays, and lacks any provision for a work area in which to hold pastels that are in use. Both kinds of boxes share the cumbersome arrangement of placing pastels separately within small compartments, each stick situated in its own slender niche.

Grouping pastel sticks in large compartments, according to hue, is a more convenient system. It allows the artist to concentrate on painting, and not be distracted by having to replace each color in its exact slot. Making such a box is described by Christopher Stones in "Painting With Pastels" edited by Peter Johnson, Cincinnati: North Light Books (1984): 127-28. Its compartments, however, become laden with dust and debris.

Color arrangement within a pastel container is critical to efficient painting. Time is always at a premium during painting, and an artist can find colors most quickly when they are in predictable locations. Colors in most pastel assortments, however, are organized according to the manufacturer's stock-numbering scheme. Currently available pastel boxes do not have any system for arranging colors that is easy to remember or maintain.

Educational value is an element of good color arrangement. Many containers have been proposed which organize actual coloring materials into instructional color charts. U.S. Pat. No. 1,805,520 to Grumbacher (1931) is one such educational device, disclosing an arrangement of paints on a circular chart-like palette. Its layout, however, limits its capacity to twelve single colors.

Keeping pastels clean is important to artists. Pastels generate dust that tends to migrate onto the surfaces of the other pastels. Some painters wipe their pastels with cleansing tissue in order to see their colors clearly. Many prior-art boxes resolve the dust problem by isolating pastel sticks within their own narrow compartments. Other types of containers, which organize colors in larger compartments, need to be emptied and cleaned periodically.

A brief survey shows a variety of problems with currently available pastel containers. The following description of prior-art containers focuses on four key issues:

(a) poor color arrangement;

(b) dust and difficulty of transport;

(c) slow, inconvenient operation; and (d) deficient educational value.

Poor Color Arrangement

"Color arrangement" is used to indicate how pastel sticks of different hues or color families are positioned within a case. Many patents directly related to artists' palettes and coloring materials have claimed their color arrangement as a significant and novel feature.

Color charts are the earliest forms of color arrangements to have been patented. U.S. Pat. Nos. 824,374 to Munsell (1906) and 1,617,024 to Munsell (1927) disclose charts organizing colors into a circular system. The ten hues of the Munsell color system, however, do not accurately reflect the full range of pigments available to fine artists.

The color triangle is one of the simplest color charts or models, and perhaps for this reason is most useful to painters. Its shape and color locations are easily visualized, more so than a color circle. Most people are familiar with its "primaries" from elementary school. The triangle positions the three primary colors, red, yellow, and blue, on its vertices, and shows how these mix to produce the secondary colors, orange, green, and violet. Mixing with these, in turn, produces the six tertiary colors, red-orange, yellow-orange, yellow-green, etc., yielding a total of twelve basic hues. At a more sophisticated level, the color triangle diagrams what are referred to as subtractive color mixtures, that is, the mixture of pigments. Artists working with traditional painting media find this figure to be a very practical tool in helping them mix complex colors and find their complements.

Attempts have been made to incorporate the color triangle into artists' containers. The Grumbacher patent, supra, is the earliest to disclose a color arrangement in both chart form, and in the form of a paint box with actual paint pigments. U.S. Pat. Nos. 3,777,414 to Robinson (1973), and 4,027,404 to Brant (1977) are both round paint palettes. All three of these patents are examples of circular variations, sometimes called color wheels, which have been devised to adapt the color triangle for use as a palette or container. Their circular arrangements use space inefficiently, making them unfit for storing and working with a large quantity of coloring materials.

Rectangular pastel containers have also been proposed. U.S. Pat. No. 1,957,816 to Braeg (1934) discloses a box with large compartments arranged in rows so that adjacent rows contain complementary colors. This arrangement, however, places sticks of different color families within each compartment, exposing each pastel to being soiled by its unrelated neighbors. U.S. Pat. No. 4,822,118 to Watkins (1989) discloses a square pastel container, but its odd, pyramid shape requires it to be frequently rotated. Neither of these patents propose a color arrangement based on a generally recognized color model.

An important benefit of good color arrangement is that colors are found quickly. The development of the printer's type case provides a relevant prior-art example. In the early days of printing, fonts of movable metal type were organized into flat, compartmented drawers. The letters were sorted in compartments in standard locations. Manual typesetting evolved into a relatively rapid procedure, because practitioners could gain speed as they became more experienced with the equipment and the layout of the type case. An artist whose palette of colors is similarly well organized can devote more attention to seeing and painting.

In prior-art containers, pastel colors are not laid out in easily visualized arrangements. This slows artists down while painting and makes it difficult to maintain a complete inventory of colors.

Dust and Difficulty of Transport

As stated, pastels are fragile and prone to being dusty. They also work best with an adequate assortment of colors. The ideal pastel container, then, must transport, in a protective manner, with some provision for keeping them clean, as large a supply of well-organized pastels as can be comfortably carried.

Several patents disclose containers that keep coloring elements clean and organized in transit. U.S. Pat. No. 1,217,283 to Daniel et al. (1917) discloses a container that holds crayons in the grooves of corrugated cardboard, a predecessor to the inconvenient pastel packaging of the present day. An alternative approach to keeping pastels clean and cushioned utilizes uncooked rice. U.S. Pat. No. 4,616,748 to Thomas et al. (1986) discloses a container in which rice grains clean and protectively cushion pastels. Within the container, a soft, open mesh allows rice grains to surround the pastels held in a stack of compartmented trays during transport, and then separates the rice from the pastels when the trays are removed. Besides burdening the artist with additional weight, a tremendous amount of agitation is needed for rice to have even a slight cleansing effect.

While many prior-art devices can protectively transport a large supply of pastels, none can conveniently and effectively keep pastels clean and compartments free of dust and debris.

Slow, Inconvenient Operation

Most currently available pastel containers present an assortment of colors in several stacking trays. Besides complicating even a simple change in working position, the artist must devote time and attention to packing and unpacking them, and to arranging them in their correct and accustomed order.

The failure of these containers to provide a single, large, empty area reserved for colors in current use makes painting with pastels unnecessarily difficult. When working outdoors, artists are often forced to pack up quickly and return a group of pastels they have been using haphazardly into whatever empty spaces are available, or risk their soiling and damage by carrying them separately.

Deficient Educational Value

Value in an educational tool or kit can be measured by its usefulness to the beginner, and whether it retains that usefulness as the student becomes more advanced.

Educational painting tools, as already noted, combine color charts with coloring materials, offering the beginning student guidance in color mixing. Their constrained shapes, however, often make them too inefficient for ongoing use.

Educational painting kits until recently have been typified by paint-by-numbers kits, several variations of which have been patented. U.S. Pat. No. 2,744,349 to Grossman (1956), for instance, discloses a paint-by-numbers kit, including a printed panel whose numbers and outlines of areas are dissolved by the paints when applied. While there may be some value in initiating the student in the handling of oil paints, these kits usually lack actual painting instruction. A further disadvantage is that their use is limited to particular projects. Many include only the colors needed to create a specific image. Such an incomplete color selection renders the kit unsuitable for later independent work.

Current technology has moved educational kits onto the home computer screen. Today's art instructions can be presented interactively, and images created on the computer screen can be reproduced through a variety of printing devices. The results are often disappointing because the colors seen on screen are usually very different from what is reproduced. Because the computer monitor mixes color based on the RGB color model which is additive, and not on the artist's traditional method of mixing colored pigments which is subtractive, much of the interactive color instruction in today's tutorial programs is not solidly related to actual painting pigments.

OBJECTS AND ADVANTAGES

Accordingly, several objects and advantages of my invention are:

(a) to provide an improved, more efficiently utilized, and convenient pastel case;

(b) to provide a pastel case whose color arrangement establishes predictable color family locations in various models and sizes;

(c) to provide a pastel case whose color arrangement can be indexed so that specific colors can be quickly found and replaced;

(d) to provide a pastel case in which pastels are conveniently cleaned and color compartments are kept free of dust and debris;

(e) to provide a pastel case in which pastels can be kept organized and protectively held in a single tray during transport and use;

(f) to provide a pastel case with ample work areas to accommodate pastels currently being used in a painting;

(g) to provide a pastel case that can rest on or be easily attached to most types of artists' easels, taborets, and other work surfaces;

(h) to provide a pastel case that can be quickly opened and closed allowing an artist to rapidly start and stop work;

(i) to provide a pastel case that can be cooperatively used with a computer for educational and computer-assisted painting projects.

Further objects and advantages are to provide a pastel case whose color arrangement can serve as the format for a palette on a computer screen for choosing colors in computer paint and image-processing programs, and whose organization of partial lengths of pastels, rather than whole sticks, accommodates a larger selection of colors in a given area. Still further objects and advantages will become apparent from a consideration of the ensuing description and drawings.

BRIEF DESCRIPTION OF THE DRAWINGS

In the drawing, closely related figures have the same number but different alphabetic suffixes.

FIG. 1-A (prior art) shows the positions of the three primary colors, red (R), yellow (Y), and blue (B), on a painter's circular diagram or color wheel.

FIG. 1-B (prior art) shows the positions of the three primary colors on a circular diagram or color wheel, according to Munsell.

FIG. 2-A (prior art) shows the positions of the three primary colors on a painter's triangular diagram or color triangle.

FIG. 2-B (prior art) is a diagram showing the positions of the three primary, three secondary, and six tertiary colors on a twelve-hued painter's color triangle.

FIG. 3 shows the positions of the three primary colors placed on a rectangular diagram, in accordance with a principle of my invention.

FIG. 4 is a rectangular diagram showing a pastel case subdivided into an arrangement of twelve equally-sized areas or positions, in accordance with a principle of my invention.

FIG. 5 is a rectangular diagram showing a pastel case subdivided into an arrangement of twelve equally-sized areas or positions, and one larger-sized area or interval, in accordance with a principle of my invention.

FIG. 6 is a diagram of the color compartment arrangement of a pastel case according to the invention, showing the correspondence of the three primaries' positions in their rectangular layout to their respective positions on the color triangle.

FIG. 7 shows the pastel case of FIG. 6, opened and ready for use, with a resilient pad held in its lid.

FIG. 8-A shows the pastel case, closed and ready for transport.

FIG. 8-B shows detail of a nesting bracket used to protectively position the resilient pad when it is removed from the lid, and the lid when it is detached from the case.

FIG. 9-A (exploded view) shows the lid of the pastel case detached, and the resilient pad removed from the lid's interior.

FIG. 9-B (exploded view) shows the two-level construction of a pastel case according to the invention, and its component structural layers.

FIG. 10-A shows the interior of the lid, the resilient pad being removed.

FIG. 10-B (detail) shows a color card inserted in a holder with its transparent overlay removed FIGS. 11-A to 11-G illustrate optional locations for storing the resilient pad and lid.

FIGS. 12-A'to 12-C (plan views) show the color chart in the lid, the color compartments, and the underlying collection chamber.

FIG. 15-A (exploded view) shows the pastel case's two structural layers or levels within a single color compartment.

FIG. 15-B (exploded view) shows component layers of a support grid used in organizing the positions of pastels within a single color compartment.

FIG. 16 (cross-sectional view of FIG. 21) shows compartment walls and pastels held in position by the resilient pad in the lid.

FIGS. 17-A (detail) and 17-B (cross-section of FIG. 17-A) show how the pastels' positions on the support grid are influenced by vertical alignment elements.

FIGS. 18-A (detail) and 18-B (cross-section of FIG. 18-A) show how the pastels' positions on the support grid are influenced by horizontal grid elements.

FIG. 19 (cross-sectional diagram) illustrates how pastels placed on the support grid are prone to come to rest in wide channels of vertical alignment elements.

FIG. 20 (cross-sectional view of FIG. 21) shows pastels held in position by the resilient pad in the lid.

FIG. 21 (overhead view) shows the pastels in a color compartment in the case.

FIG. 22-A (plan view) shows the top portion of the current palette area, and a neutral-hue compartment and adjacent refill area.

FIG. 22-B (detail) shows an interwoven mesh surface of the current palette area.

FIGS. 23-A to 23-B are diagrams which illustrate the selection and preferred organization of pastel colors within one of the pastel case's main color compartments.

FIG. 24-A diagrams the orientation of pastel colors of FIG. 23-B according to saturation.

FIG. 24-B diagrams the orientation of pastel colors of FIG. 23-B according to value.

FIG. 25 shows a color card indexing pastels of a Red-Violet color compartment, labeled with a transparent overlay.

FIG. 29-A shows the pastel case's placement for use with a portable artist's easel.

FIG. 29-B (exploded view, detail) shows how straps engage anchor bars to secure the pastel case to a support surface (shown in FIG. 29-A).

FIG. 29-C shows lock-down devices used to anchor pastel case to a support surface.

FIG. 30 shows the pastel case attached to a French easel.

FIGS. 31-A to 31-C diagram alternative layouts of the pastel case's color compartment arrangement.

FIG. 32 is an overhead view showing different-sized pastel cases in use.

Figure 13:
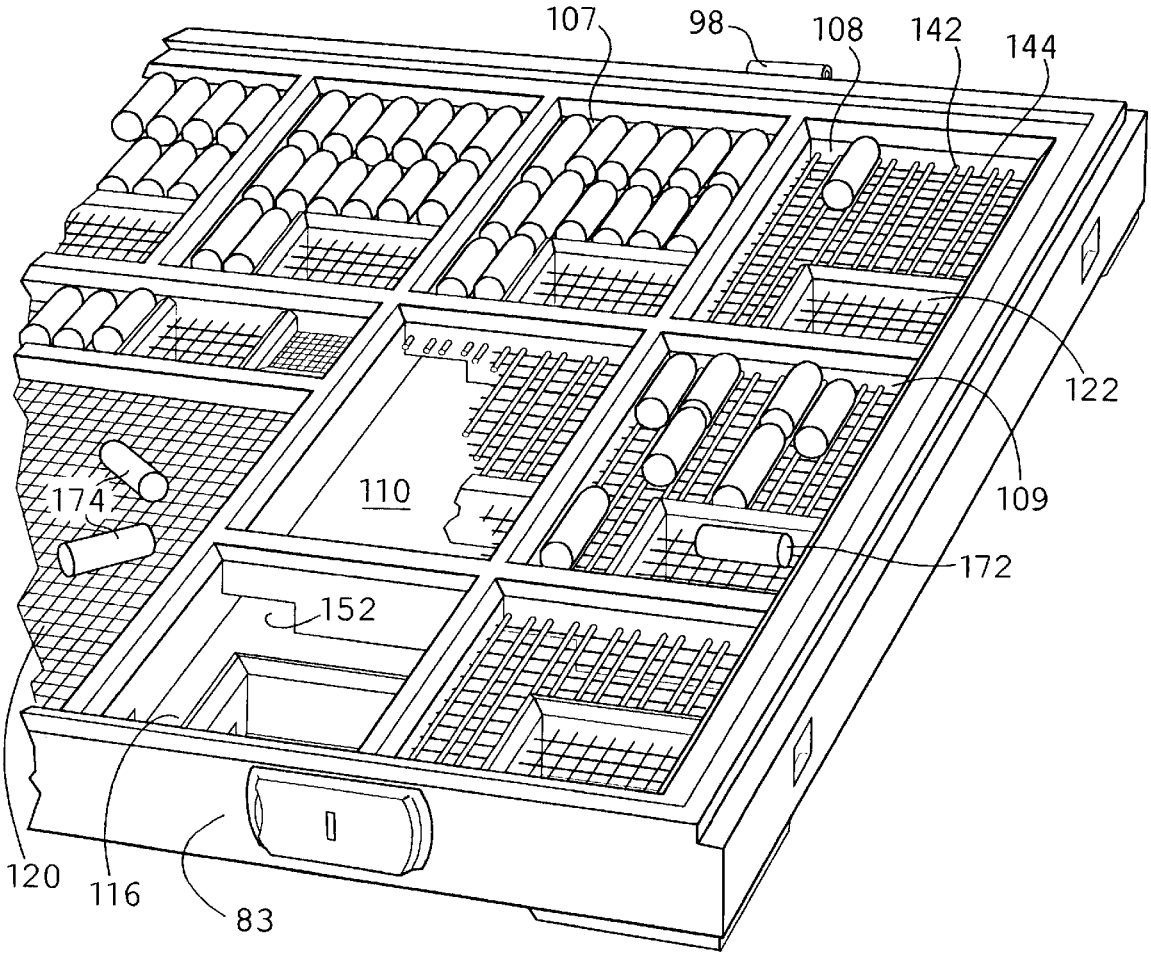
FIG. 13 (partial cut-away) shows details of the color compartments in operation.

| Reference Numerals in Drawings | |
|---|---|
| 36 | red primary position |
| 37 | yellow primary position |
| 38 | blue primary position |
| 39 | color diagrams |
| 40 | interval |
| 41 | main color compartment |
| 42 | debris outlet |
| 43 | neutral-hue color compartment |
| 46 | attachment slot side opening |
| 47 | attachment slot bottom opening |
| 48 | front anchor bar |
| 49 | rear anchor bar |
| 50 | pastel case |
| 52 | bottom nesting bracket |
| 56 | foot surface |
| 58 | bracket ends |
| 60 | lid |
| 61 | lid exterior |
| 62 | lid nesting bracket |
| 64 | gripping-surfaces |
| 66 | central gripping-surface |
| 68 | lid hinge element |
| 69 | side walls of lid |
| 70 | resilient pad |
| 76 | lid-facing surface |
| 78 | gripping-material |
| 80 | bottom |
| 81 | side bottom edge |
| 83 | front |
| 84 | handle |

-continued

| Reference Numerals in Drawings | |
|---|---|
| 85 | case latch |
| 86 | lid latch |
| 88 | lid support pin |
| 90 | lid support |
| 94 | side of pastel case |
| 96 | lid support recess |
| 97 | locking lever |
| 98 | case hinge element |
| 99 | color compartment |
| 100 | color compartment arrangement |
| 101 | Red compartment |
| 102 | Red-Orange compartment |
| 103 | Orange compartment |
| 104 | Yellow-Orange compartment |
| 105 | Yellow compartment |
| 106 | Yellow-Green compartment |
| 107 | Green compartment |
| 108 | Blue-Green compartment |
| 109 | Blue compartment |
| 110 | Blue-Violet compartment |
| 111 | Violet compartment |
| 112 | Red-Violet compartment |
| 113 | Red-Neutral compartment |
| 114 | Orange-Neutral compartment |
| 115 | Yellow-Neutral compartment |
| 116 | Green-Neutral compartment |
| 117 | Blue-Neutral compartment |
| 118 | Violet-Neutral compartment |
| 119 | refill area |
| 120 | current palette area |
| 122 | holding area |
| 123 | double beveled surface |
| 124 | holding area wall |
| 125 | component color chart |
| 126 | transparent overlay |
| 128 | color card |
| 129 | recess |
| 130 | lid's interior surface |
| 132 | interior gripping-surfaces |
| 134 | flanged retaining elements |
| 135 | color card holders |
| 136 | slide-in notch |
| 138 | fingernail recess |
| 140 | support grid |
| 142 | vertical alignment elements |
| 144 | horizontal grid elements |
| 146 | bottom grid elements |
| 148 | non-aligning mesh |
| 149 | color compartment level |
| 150 | compartment foundation |
| 152 | gaps |
| 154 | collection chamber floor |
| 155 | collection chamber |
| 156 | lid-hinge bumper foot |
| 157 | bumper feet |
| 158 | case-hinge bumper foot |
| 160 | compartment wall |
| 162 | narrow top |
| 164 | beveled surface |
| 166 | partition |
| 167 | fine-mesh screen |
| 168 | refill area ramp |
| 169 | pastel fragment |
| 170 | pastel |
| 171 | space between pastels |
| 172 | pastel in holding area |
| 174 | pastels on non-aligning mesh |
| 176 | pastel dust and debris |
| 177 | vacant position |
| 178 | pastel of smaller diameter |
| 180 | color picker |
| 182 | selected color compartment |
| 184 | magnified color compartment |
| 186 | pastel color element |
| 187 | image field |
| 188 | paint bucket icon |
| 190 | color sample |
| 192 | assigned position index |

-continued

| Reference Numerals in Drawings | |
|---|---|
| 194 | RGB value index |
| 198 | support surface |
| 200 | elastic strap |
| 202 | strap hook |
| 204 | tongue or hood-like element |
| 206 | studio sized case |
| 208 | color area (block in shadow) |
| 209 | color area (cast shadow) |

SUMMARY

A pastel case according to the invention groups artists' pastels or similar coloring elements in a rectangular arrangement of color families based on a painter's color triangle. The case has an open, mesh-like support grid to keep pastels clean, provides empty work areas, and organizes an indexed set of colors for cooperative use with computer paint and tutorial programs.

DESCRIPTION—Color arrangement—FIGS. 1-A to 6

An important aspect of the pastel case is the specific sequence and locations of its color compartments. This color arrangement, and its conversion of the painter's color triangle into a rectangular array of color families may be best understood by examining the following figures: FIGS. 1-A to 2-B show prior-art circular and triangular color diagrams. FIGS. 3 and 4 show the evolution of a rectangular color arrangement for a pastel case. FIGS. 5 and 6 show the specific color arrangement of a pastel case according to the invention.

FIG. 1-A is a circular diagram showing the prior-art positions of the three subtractive primary colors, red, yellow, and blue, indicated by R, Y, and B, on a color wheel.

FIG. 1-B shows the prior-art positions of the three primaries, R, Y, and B, on a color wheel according to the Munsell color system. The short distance between R and Y indicates a compression of the orange range.

FIG. 2-A diagrams how the prior-art positions the three primary colors, R, Y, and B, at the vertices of a painter's color triangle.

FIG. 2-B diagrams a prior-art painter's color triangle (FIG. 2-A) in detail, showing the positions of the secondary and tertiary colors. The visual spectrum is thus divided into twelve basic hues or color families. The sequence of twelve hues, proceeding clockwise around the triangle beginning at its bottom left vertex, is red, red-orange, orange, yellow-orange, yellow, yellow-green, green, blue-green, blue, blue-violet, violet, and red-violet. FIG. 2-B also indicates by dashed lines the complementary color relationship between the primary and secondary colors.

FIG. 3 shows the same relative positions of the three primary colors, found both in the circular diagram and the triangular diagrams (FIGS. 1-A, 2-A, and 2-B), placed on a hypothetical rectangular diagram.

FIG. 4 is a diagram showing, within a pastel case, a rectangular arrangement, in two rows, of twelve equally sized areas or positions. With R placed in the lower left position, and three positions intervening in a clockwise direction between R, Y and B, an asymmetrical configuration of the three primary colors results.

FIG. 5 is a diagram showing, within a pastel case, a rectangular arrangement, in two rows, of twelve equally sized areas or positions, and a single larger area or interval 40. The three primary colors, R, Y, and B, are shown respectively positioned in an area 36, 37, and 38. The introduction of interval 40 into the bottom row allows the array of twelve areas to be configured so that the relative positions of the three primary colors in areas 36, 37, and 38 are the same as the primaries shown in FIG. 3. Thus arranged, the positions of the primaries in FIG. 5 are analogous to their positions on the prior-art color triangle (FIGS. 2-A and 2-B).

FIG. 6 diagrams an arrangement of main color compartments 41 in a pastel case according to the invention, based fundamentally on the layout shown in FIG. 5. A portion of the color triangle diagram of FIG. 2-B is superimposed, and a row of smaller auxiliary or neutral-hue compartments 43 has been added at the bottom. FIG. 6 shows that the relative positions of the three primary colors (areas 36, 37, and 38) in the rectangular layout of main color compartments are the same as the relative positions of the three primary colors in the prior-art color triangle.

Pastel Case General Construction—FIGS. 7 to 10-B

The general construction of my pastel case using the color arrangement above may be best understood with reference to FIGS. 7 to 10-B. The preferred materials used in its fabrication, unless otherwise specified, are rigid plastics with rubber-like veneers, or other suitable, lightweight materials and finishes.

FIG. 7 shows a pastel case 50 to be basically a compartmented tray with a detachable lid 60. Nesting within lid 60 is a removable resilient liner or pad 70. When the case is closed, pastels are protectively cushioned and held in fixed position by this pad which is composed primarily of foamed polyurethane or other suitable type of compressible material. A handle 84 and a pair of female or case latches 85 are disposed on an exterior front wall or front 83 of the case. A pair of cooperating male or lid latches 86 are disposed on the lid. A lid support 90 swings out of a recess 96 located along a side wall 94 of the case. Support 90 engages a lid support pin 88 located on the interior of a side wall 69 of the lid. Several support pins disposed in this area allow the lid to be held open at various angles.

FIG. 8-A shows an exterior underside or bottom 80 of the closed pastel case. A front anchor bar 48 and a rear anchor bar 49 are located along, flush with, and contiguous to each side bottom edge 81 of the case. The anchor bars are formed by four L-shaped rectangular cavities or attachment slots with a pair of openings 46 in each side 94 of the case, and an opening 47 in the bottom of the pastel case, disposed near each corner. A bottom nesting bracket 52 is also located near each corner of bottom 80.

FIG. 8-B shows bottom nesting bracket 52 to have a foot surface 56 made from a resilient, non-abrasive material. Bracket ends 58 are beveled to prevent snagging and personal discomfort when the pastel case is carried. The bottom nesting brackets act as nonskid, cushioned feet which keep the pastel case from shifting on, or marring, tables and other supporting surfaces. As discussed below, they also allow the resilient pad and removable lid to nest underneath the pastel case.

FIG. 9-A shows the lid detached from the case and the resilient pad removed from the lid. A layer of gripping-material 78 which acts as a component of hook-and-loop or other type of or fastening means is affixed to the resilient pad's lid-facing surface 76. A pair of lid hinge elements 68 have been disengaged from a pair of cooperating case hinge elements 98. A locking lever 97 prevents the hinges from disengaging inadvertently.

The pastel case has a two-level or dual-chamber construction, as illustrated in FIG. 9-B. Case 50 has a rectangular base or collection chamber floor 154 (interior side of bottom 80). Attached to floor 154, in ascending order, are a compartment foundation 150, a support grid 140, and a partitioning matrix or color compartment arrangement 100. Arrangement 100 comprises a plurality of compartment walls 160 and holding area walls 124, creating a series of color compartments 99, and holding areas 122. Arrangement 100, combined with support grid 140, form an upper level or color compartment level 149 of the pastel case in which the pastels are held for the artist's use. Collection chamber floor 154 and compartment foundation 150 form a lower level of the pastel case or collection chamber 155. An opening or debris outlet 42 vents collection chamber 155.

FIG. 10-A shows the inside of the lid with the resilient pad removed. The lid's four side walls 69 form a shallow enclosure or recess 129 which the resilient pad occupies when the case is closed for transport. The lid's interior surface 130 contains various elements arranged to create a series of shallow, color card holders 135. Holders 135 are disposed in relative sizes and positions corresponding to each of the case's color compartments, and are each intended to hold and display a flexible color card 128 (FIG. 10-B). Color card 128 displays a plurality of color samples 190 corresponding to the colors and arrangement of the pastels respectively assigned to each compartment (FIGS. 10-B and 25).

FIG. 10-B shows holder 135 to be a flanged, rectangular recess whose operation is similar to that of a photographer's sheet film holder. Color card 128 has been slid into the holder which is bordered on three of its sides by a flanged retaining element 134. Located at a fourth side of holder 135 is a bordering element containing a fingernail recess 138, flanked on both sides by a slide-in notch 136. Affixed to some of the elements inside the lid are a plurality of hook-and-loop gripping-surfaces 132 or other fastening means compatible with and capable of engaging the material affixed to the resilient pad's lid-facing surface 76. A transparent overlay 126 is shown having been removed from the holder. A cross-sectional view of color card 128 being held in its holder is shown in FIG. 16. Together these color cards create a component color chart 125 in the lid (FIG. 12-A).

Removable pad and lid—FIGS. 11-A to 11-G

Lid and pad removal, as well as storage, are illustrated by FIGS. 11-A to 11-G. There are several reasons for removing the lid, the first of which is to allow light coming from a specific direction to fall evenly onto the entire array of pastels. Second, in adverse weather, the lid's removal can prevent it from being toppled by a strong gust of wind. Third, its removal provides an unobstructed view over the case while the artist is seated. FIGS. 11-A to 11-D sequentially diagram, from the side, the way in which the lid is detached and turned over so that it can be stowed underneath the case.

FIG. 11-E illustrates how bottom nesting brackets 52 engage the resilient pad, and keep it protectively secured underneath the case. The resilient pad is removed from the lid whenever the artist wishes to view the component color chart. Storage areas are provided to protect the pad from loss or damage, and to keep it close at hand, should the case need to be quickly closed and transported. The resilient pad, with or without the detached lid, may be stored underneath the pastel case as shown in FIG. 11-E. It may also be temporarily attached to the exterior surface of the lid (FIG. 11-G)

FIG. 11-G shows the lid to have a top surface or lid exterior 61, upon which a lid nesting bracket 62 is disposed near each corner. Brackets 62, similar in structure to bottom nesting brackets 52, serve as nonskid, cushioned feet when the lid is stored under the pastel case. They also define a storage area for the resilient pad when it is removed from inside the lid. A central gripping-surface 66, and a plurality of smaller gripping-surfaces 64 are shown attached to lid exterior 61. These gripping-surfaces engage the material on lid-facing surface 76 of the pad and keep it secured, even when the lid is tilted back (FIG. 11-F).

Figure 14:
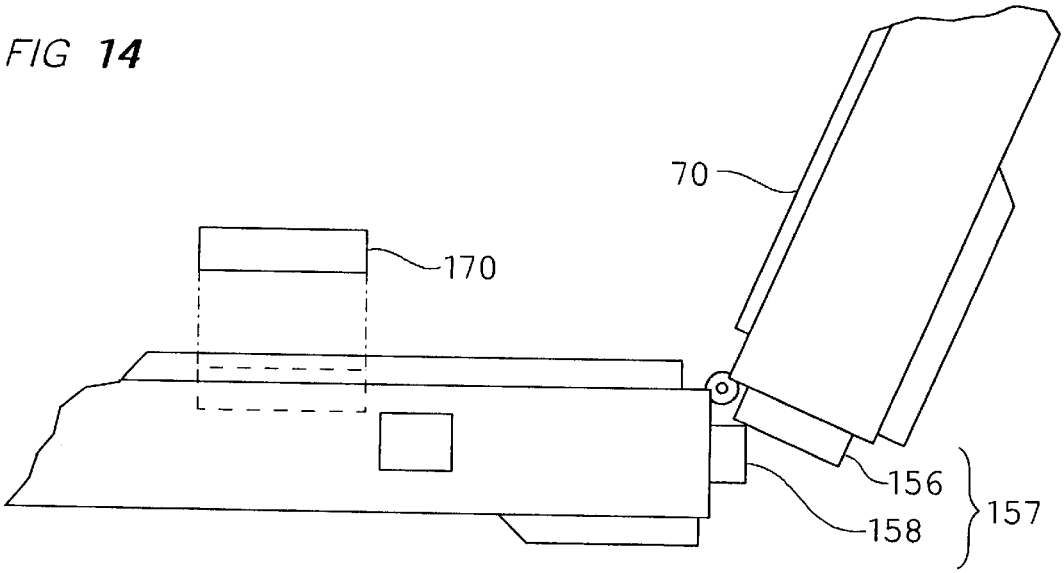
FIG. 14 (elevation view) shows detail of right side of the pastel case with the lid opened to maximum angle.

FIG. 11-G also shows a set of bumper feet 157, comprising a lid-hinge bumper foot 156 and a case-hinge bumper foot 158 at each hinge location. Bumper feet 157 allow the closed case to stand vertically (FIG. 8-A), and support the opened lid at a fixed angle (FIG. 14).

Color compartment arrangement—FIGS. 12-A to 12-C

The color compartment arrangement is shown in plan views (FIGS. 12-A to 12-C) which illustrate the color chart's correspondence to the color compartments, and their underlying structure. FIG. 12-A shows the component color chart in the opened lid.

FIG. 12-B shows the actual color compartments. Their layout as diagrammed in FIG. 6 includes a series of twelve large or main color compartments 41 and six smaller auxiliary or neutral-hue compartments 43. The preferred embodiment shown in FIG. 12-B assigns the locations of the twelve hues or color families, and the six neutral-hues as follows:

(Main color compartments)
- 101 Red compartment
- 102 Red-Orange compartment
- 103 Orange compartment
- 104 Yellow-Orange compartment
- 105 Yellow compartment
- 106 Yellow-Green compartment
- 107 Green compartment
- 108 Blue-Green compartment
- 109 Blue compartment
- 110 Blue-Violet compartment
- 111 Violet compartment
- 112 Red-Violet compartment (Neutral-hue compartments)
- 113 Red-Neutral compartment
- 114 Orange-Neutral compartment
- 115 Yellow-Neutral compartment
- 116 Green-Neutral compartment
- 117 Blue-Neutral compartment
- 118 Violet-Neutral compartment FIG. 12-B also shows two other color compartments. A compartment 119 will be referred to as the refill area. A compartment 120 will be referred to as the current palette area. Both compartments 119 and 120 are empty work areas, not assigned any hues or color families. A card of color diagrams 39, as shown in FIG. 12-A, can be displayed in the lid in the large space corresponding to the current palette area.

FIG. 12-C shows the plan of collection chamber 155. This lower level of the case is partitioned by compartment foundation 150, a labyrinth of elements which underlie and support the compartment walls. A plurality of gaps 152 provide, from any point on the collection chamber floor, a maze-like path leading to debris outlet 42.

Color compartments—FIGS. 13 to 16

The color compartments, shown in FIGS. 13 to 16, may be best understood if their form and function are examined together.

The compartments of FIG. 13 are illustrated in a variety of states. Compartment 107 is shown loaded with pastels aligned end to end, lying on their sides in vertical columns (as viewed by the artist who is normally stationed at front 83 of the case). Compartment 108 is shown with a single pastel to give a clear view of the three components which organize pastels within each compartment. The first such component is a series of parallel, elongated members or vertical alignment elements 142. The second is a series of parallel, elongated members or horizontal grid elements 144 which lie under and perpendicular to vertical alignment elements 142. The third organizing component is holding area 122. Compartment 109 is an example of a compartment in use. Pastel 172 has been removed from its assigned position and placed in the compartment's holding area. Other pastels 174, selected for continued use in a painting, have been placed in current palette area 120. Compartments 110 and 116 are shown with all or a portion of their support grid cut away to reveal the structure of the collection chamber below.

FIG. 14, in a close-up elevation of the right side of the case, shows the relative size and disposition of a single pastel 170 within it. This view also shows how hinge bumper feet 156 and 158 operate to support the lid open at a fixed angle, without the lid support.

FIG. 15-A is an exploded view similar to that shown in FIG. 9-B; it shows the structure of a single main color compartment. An analysis of the support grid within this compartment is shown in FIG. 15-B. Support grid 140' comprises a three-layered network of elements. These elements may be made from metal, plastic, or other suitably rigid materials. The top layer contains vertical alignment elements 142 which extend through the entire color compartment, except for the space occupied by the holding area. The middle layer contains horizontal grid elements 144, a series of parallel elements of a narrower gauge than, underlying, and perpendicular to vertical alignment elements 142. The combination of these two layers containing elements 142 and 144 creates a mesh flooring with a gridiron-like surface, the channels of which hold the pastels in alignment. The bottom layer is an area containing a parallel series of bottom grid elements 146, which lie under and perpendicular to elements 144. The layers containing elements 146 and elements 144 combine to create a surface of channels which run horizontally within holding area 122 (FIG. 15-A.

FIG. 16, a sectional view of FIG. 21, shows the construction and function of the color compartment walls. Compartment wall 160 is shown to have a narrow top 162, flanked on either side by a beveled surface 164. Holding area wall 124 is shown to have a double beveled surface 123 forming its top. These beveled surfaces allow the artist's fingertips to more easily grasp the pastels. They also allow pastel debris 176, which might otherwise collect on these areas, to slide off and fall into the collection chamber below each compartment. Support grid 140 is suspended above floor 154 by being sandwiched between compartment foundation 150 which underlies and is joined to compartment walls 160 and holding area walls 124 above it.

Alignment elements—FIGS. 17-A to 21

Vertical alignment elements within color compartments, and horizontal grid elements within holding areas, create tracks or channels on the surface of the support grid. Their influence on pastels' positions is shown in FIGS. 17-A to 21.

FIG. 17-A shows a perspective view of pastels resting in the channels formed by the vertical alignment elements. FIG. 17-B shows the same pastels in cross-section. Vertical alignment elements 142 are spaced apart at predetermined alternating intervals. The widths of alignment elements 142 are typically 1.6 mm (1/16") and they are spaced apart so that the intervals between them measure alternately 3.2 mm (1/8") and 6.4 mm (1/4").

A similar group of pastels resting on the type of horizontal grid elements found in a color compartment's holding area is shown in FIGS. 18-A (perspective view) and 18-B (cross-section). Horizontal grid elements 144 are of a narrower gauge than vertical alignment elements 142 (FIG. 17-B). The horizontal grid elements are uniformly spaced apart, with their axes positioned at 6.4 mm (1/4") intervals.

FIG. 19 illustrates how the vertical alignment elements create wide and narrow channels, and how pastels are prone to fall or roll into, and come to rest within the wide channels. Pastel 170-A lies balanced precariously on the narrow channel, while pastel 170-B occupies with more stability because of its lower center of gravity, the wide channel. Pastel 170-C is shown having moved from a position balancing on a narrow channel into a more stable position in the adjacent wide channel. Thus, the alternately spaced alignment elements form specific channels in which the pastels tend to come to rest.

The resilient pad's effective immobilization of pastels in the vertical alignment channels is illustrated in FIG. 20. Pastels are held securely in position, even when they are of smaller diameter such as pastel 178, or placed next to a channel with a vacant position 177. Pastel dust and debris 176 still falls through the channels into the collection chamber below.

FIG. 21 shows pastels aligned in columns within a color compartment. Such alignment, while not immobilizing, keeps the pastels in fixed relative positions. The pastels slide easily up and down within the channel, but are prevented from rolling sideways. Sliding the pastels within their assigned column helps consolidate space, making room for additional pastel 170-D. Sliding also makes them easier to pick up. Pastel 170-E is shown slid up toward the top of the color compartment, opening up a space 171, thus allowing a fingertip to more easily access pastel 170-F. The pastels of FIG. 21 are shown with pad 70 and lid 60 closed upon them in cross-sectional views (FIGS. 20 and 16).

Refill area and current palette area—FIGS. 22-A to 22-B

The refill area, and a detailed view of the top portion of the current palette area are shown in FIG. 22-A. Refill area 119 is separated from the current palette area by a partition 166, and floored with a fine-mesh screen 167. The fine grade of this mesh screen is able to support a pastel fragment 169, but still allow dust to fall through into the collection chamber below. A concave inclined wall or refill area ramp 168 curves up from screen 167 to the top of partition 166. The support grid of current palette area 120 differs from that of the rest of the pastel case in that it is a non-aligning mesh 148, constructed of interwoven elements forming a conventional screen-like grid similar to 6.4 mm (1/4") hardware cloth. A characteristic of this interwoven mesh, as shown in FIG. 22-B, is that it does not have any channels. Pastel 174, lying on this type of surface, is not influenced into any particular alignment, but may assume any orientation in which it is set down. While pastels may be pushed or rolled in any direction on it, the bumpy surface of mesh 148 discourages pastels from freely rolling about.

Color family organization—FIGS. 23-A to 25

Pastel sticks are grouped into color families and assigned to positions within each of the twelve main color compartments as illustrated in FIGS. 23-A to 25. While it is to be understood that they may be chosen and organized by each artist, the preferred manner of selecting and arranging pastel colors within each color compartment is as follows:

In the diagram of FIG. 23-A, using as an example the red-violet color family, a range of twenty-seven colors is shown organized into three saturation levels. The top level is labeled SAT for saturated, the middle MOD for modified, and the lower level DULL for dull. Each of these levels of red-violet contains elements which range, from left to right, in nine steps of value from dark to light. This diagram represents a manageable assortment of red-violet pastels.

Within a color family there can be minor variations of hue, otherwise grouping the entire visible spectrum into twelve color families would be an oversimplification. Some warm and cool variations of the basic hue within each color compartment (rather than simply three saturation levels of a single hue) will present the artist with a livelier, expanded assortment of colors.

FIG. 23-B is a diagram showing a group of fourteen colors which have been selected from the range of twenty-seven colors shown in FIG. 23-A to fill the Red-Violet color compartment whose color card is illustrated in FIG. 25. FIG. 23-B shows that of the fourteen colors selected there are eight values of saturated red-violets, and three values of moderate saturation alternating with three values of dull saturation. This selection of colors from the three saturation levels and nine value columns approximates the orientating scheme illustrated in FIGS. 24-A and 24-B.

FIG. 24-A is a diagram showing that saturated colors are placed toward the outside perimeter of the color compartment, while dull and moderate colors are placed immediately adjacent to the holding area. FIG. 24-B is a diagram showing that the values of the selected colors run dark up to light, from bottom left to top right.

FIG. 25 shows a color card for the Red-Violet color compartment intended for insertion and display in the lid of the pastel case. The optional, numerical labeling is accomplished by a transparent overlay. Various overlays can be interchangeably used for different purposes. In this computer-compatible example, an index labeling each pastel's assigned position 192 appears underneath an index of its RGB values 194.

Figure 26:
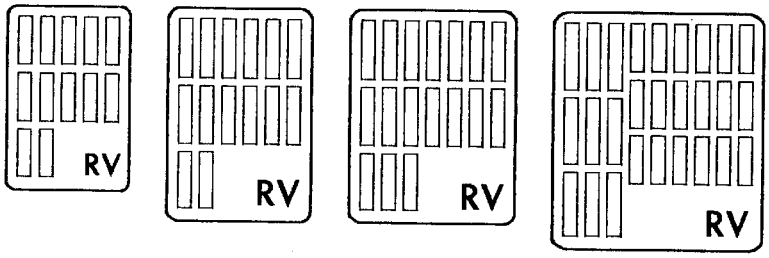
FIG. 26 is a diagram showing different sized color cards corresponding to color compartments of different sized pastel cases.
Figure 27:
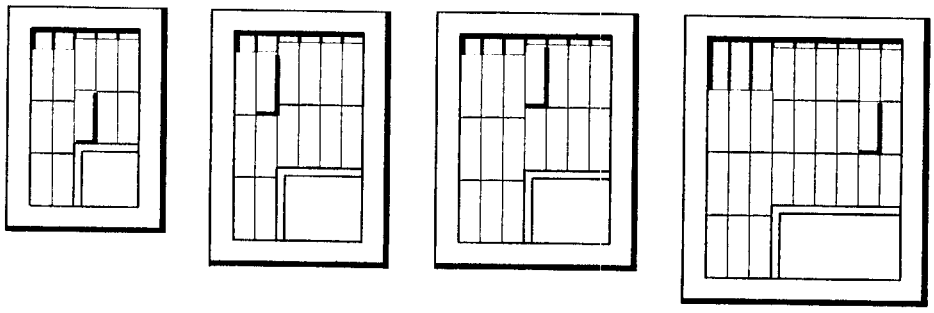
FIG. 27 is a diagram showing computer screen representations of color compartments of different sized pastel cases.
Figure 28:
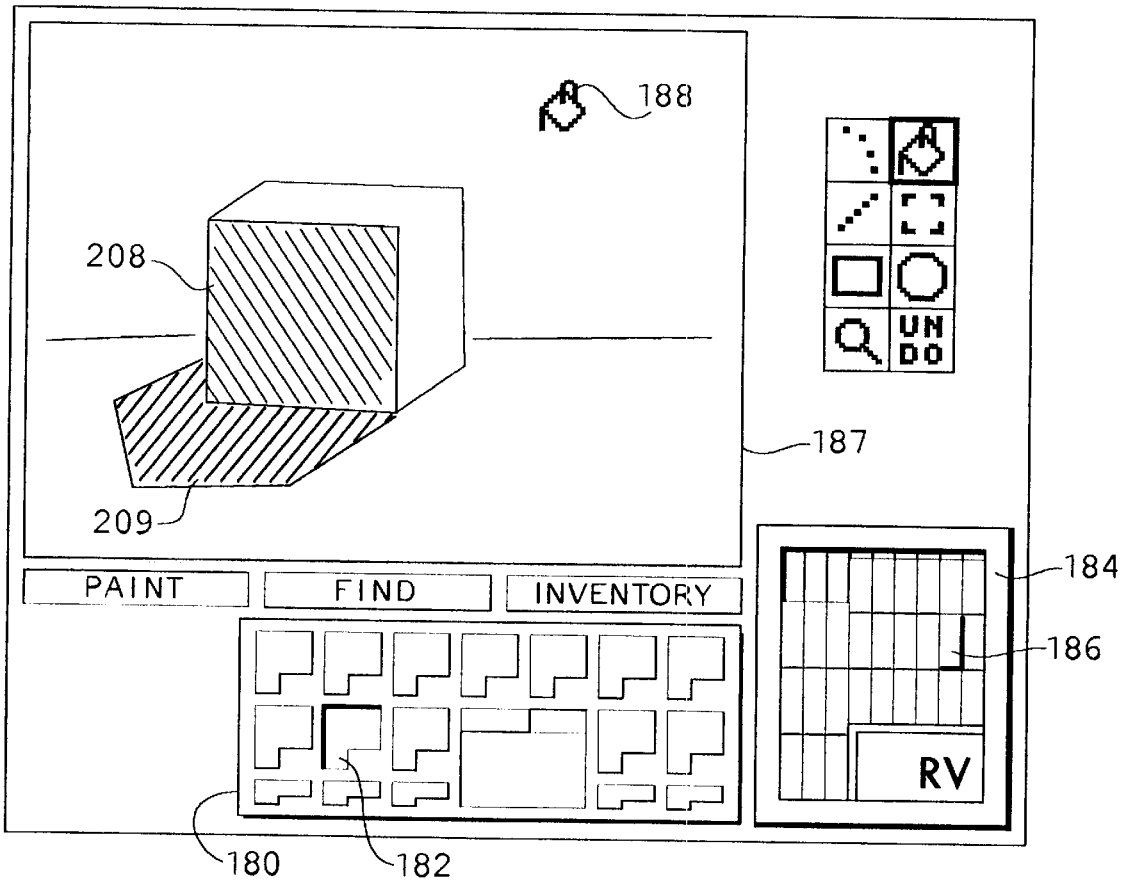
FIG. 28 shows a graphical user interface of a computer paint program employing the pastel case's color compartment arrangement as a color picker.

Computer cooperation—FIGS. 26 to 28

The pastel case's cooperative use with computer paint and tutorial programs is illustrated in FIGS. 26 to 28. FIG. 26 is a diagram showing color cards indexing pastels in color compartments of different-sized pastel cases. FIG. 27 shows corresponding computer-screen representations of the color compartments indicated in FIG. 26. FIG. 28 shows the graphical user interface of a computer paint program employing the case's color compartment arrangement as a palette or color picker 180. A selected color compartment 182 is represented on screen as a button, its depressed appearance indicating its having been selected. Appearing to the right of color picker 180 is a magnified color compartment 184. Compartment 184 displays a simulation of the selected pastel color family (red-violet). Its size corresponds to the size of the pastel case being used (FIGS. 26 and 27).

A pastel color element 186 has been selected, as indicated by its raised appearance. A tool cursor in the form of a paint-bucket icon 188 appears in an image field 187. A color area of a block in shadow 208, and a color area of a cast shadow 209, are shown forming part of a color exercise in image field 187.

The interactive cooperation of the pastel case with this type of paint program alone, and in association with computer-assisted painting instructional programs, as well as other computer applications, will be explained in further detail under Operation.

Attachment—FIGS. 29-A to 30

Attachment slots and anchor bars, shown in FIGS. 29-A to 30, allow the pastel case to be fastened to a variety of artists' easels and other work surfaces.

FIG. 29-A shows how the pastel case can be attached to a tripod field easel. FIG. 29-B shows how attachment slots 46 are each disposed to receive a strap hook 202 from a pair of elastic straps 200, allowing them to respectively hook onto and engage front anchor bars 48 and rear anchor bars 49, thus securing the pastel case to a support surface 198 underneath. FIG. 30 shows the pastel case similarly strapped onto the extended drawer of a French easel.

Elastic straps also allow the case to be quickly mounted to, and dismounted from, a wide variety of improvised supports such as tables, ironing boards, desks, etc. Other types of tie-down straps, wire, and cords can be used, in some cases to prevent such quick release. More permanent fastening means can be used when the artist needs to securely lock down the case, or at a location where it is repeatedly mounted and dismounted, such as an artist's studio. FIG. 29-C shows two examples of lock-down devices with a tongue or hook-like element 204 capable of engaging the attachment slot and anchor bar at the bottom of the pastel case.

FIGS. 31-A to 31-C show diagrams of alternative layouts or versions of the color compartment arrangement. FIG. 31-A shows the current palette area's location changed to suit left-handers. FIG. 31-B shows the current palette area's location moved farther to the right. FIG. 31-C shows a version without any neutral-hue compartments, and with the positions of the blue and red primaries (at the base of the color triangle) exchanged so that the Blue compartment is on the left and Red compartment is on the right.

FIG. 32 is an overhead view showing an artist using the preferred embodiment of the pastel case attached to an easel, and indicating the feasible positioning of a larger, studio sized case 206.

Operation—Color arrangement—FIGS. 1-A to 6

For simplicity and practical convenience, the case's color arrangement is based on the painter's color triangle, organizing a selection of pastels into twelve main color compartments, and six smaller neutral-hue compartments (FIG. 6).

Each main color compartment 41 groups pastels belonging to a color family corresponding to one of each of the twelve hue classifications located at points on the painter's color triangle shown in FIG. 2-B.

Neutral-hue compartments 43 (FIG. 6), five across the bottom, and a sixth at the top of the current palette area, are intended to hold extremely dull hues, such as earth colors. FIG. 12-B shows the specific layout of neutral-hue compartments 113, 114, 115, 116, 117, and 118.

The advantages and superiority of the triangle over the circle as a color model for the painter should be restated, especially since some color wheels or circles have become standards for artistic use. Most notable is the previously cited Munsell color system, U.S. Pat. No. 824,374 to Munsell (1906) and 1,617,024 to Munsell (1927), which discloses a contrived, metric-friendly color circle of ten hues.

First, the color triangle's twelve hue classifications correspond more closely to the artist's spectrum of pigments, including a full range of oranges. Second, the painter's triangle is more mnemonic than circular systems. The triangle (FIGS. 2-A and 2-B) is a more distinctive and stable figure than the color circle (FIGS. 1-A and 1-B), having a clearly defined top and base. Since its three primary colors are at fixed geometric positions in space, the triangle is easily visualized, enabling the artist to quickly and instinctively reach in the proper direction for a particular color.

Color chart—FIG. 12-A

Component color chart 125, displayed in the lid of the pastel case (FIG. 12-A), maps the layout of the color compartments. Each color card 128 shows the assigned positions of pastels of a given color family, and is labeled by a transparent overlay. Any of the labels, cards, or diagrams in the lid can be interchangeably removed and replaced by the artist. For example, once the color compartments' layout is memorized, the artist may prefer to not have labels when painting in the field. Alternatively, when employing the pastel case as an educational tool, checking inventory, or when using it with a computer tutorial, the labels can be replaced to aid in color identification and selection.

Assigned positions—FIGS. 21 and 25

Prior-art pastel containers are of two basic types, either organizing colors individually in niches, or grouping them generally in large compartments. The present improvement is a new type, grouping color families in a well-organized sequence of compartments, while assigning and holding each pastel in a fixed relative position within its group.

FIG. 21 shows how alignment elements 142 hold pastels in fixed relative positions. The indication on the color card of each pastel's relative position in the compartment (FIG. 25) constitutes its assigned position. The capacity to hold pastels in assigned positions within color compartments provides several benefits: First, during painting, the pastels stay organized. The relative positions of the other pastels do not shift when a pastel is removed from a compartment. Second, a chart can display color samples of all available pastels in assigned positions, and help in keeping the case orderly. Pastels out of position can be compared with the chart and quickly placed back where they belong. Third, pastels with minor differences in hue, saturation, or value are more easily distinguished when assigned adjacent positions. The artist can make more accurate choices between subtly different colors. Fourth, assigned positions on each color card can be labeled with identifying information. The artist can more easily check inventory and replenish needed colors. Fifth, as will be explained under computer cooperation, assigned positions can be indexed to computer palettes.

Pastel painting, in the traditional manner, is made more efficient by several of the case's operational features:

Opening and closing—FIGS. 7 and 8-A

FIG. 8-A shows the closed case, awaiting transport to a painting site. Bumper feet 157 let it stand firmly balanced on its hinged edge like a large attache case. FIG. 7 shows the just opened case, ready for use. The complete range of colors has been kept in position and safely cushioned by resilient pad 70 during transport. Since the pastels are presented in a single, flat array, opening and closing the case is fast and simple.

Empty work areas—FIGS. 13 and 22-A

FIG. 13 shows that, as the artist paints, each pastel that is used may be returned to its assigned position, or set aside in one of several empty areas reserved for this purpose. These areas save time and effort, since colors used in a painting often need to be found and used again. They also allow artists to focus their attention on the painting process and not be overly concerned with keeping their colors in order.

Current palette area 120 is the first of three types of empty work areas which the pastel case provides for the placement and storage of colors in current use. Because of its large size, and central location, most colors in current use are placed here.

Holding area 122 is a second type of empty work area, located in the lower right hand corner of each color compartment. Its chief function is to "flag" selected colors, allowing a pastel to be returned to a compartment without being placed in its assigned position. Placement in the holding area clears the current palette area of infrequently used colors, yet makes the pastel easy to find should it be needed again. In addition to its location, the horizontal orientation of pastel 172 (FIG. 13) is a further indication of its being such a selected color.

Refill area 119 is the third type of empty work area (FIG. 22-A). This small partitioned area has a fine-meshed floor which holds very small particles (pastel fragments that would normally fall through the support grid into the collection chamber below). Thus, the remaining particles of pastel colors that have been just used up can be safely held here, and replenished at the artist's next opportunity. Fragments of colors that are simply getting small can be placed here, too, as a memo to add fresh stock. Ramp 168, at the front of the refill area, curves up from the fine-meshed screen floor, making it easy for the artist to retrieve any small fragments placed here.

These three types of empty work areas keep pastels organized while a work is in progress, and allow the case to be closed on short notice. When closed, the colors in current use stay segregated in whatever work area they have been placed. This keeps them clean and well protected while the case is transported, and in the same position, ready for use again, when the case is reopened. Thus the artist may stop and later resume work on the same painting with the previously selected palette of colors still intact.

Cleaning—FIGS. 8-A, 9-B, and 12-C

The cleaning function of support grid 140 may be understood by viewing FIG. 9-B. This grid allows pastel dust and other particles to automatically fall into collection chamber 155 below. Consequently, since the color compartments are not laden with debris, pastels may be easily cleaned of any surface soil by a few quick swipes of a feather duster. This is also convenient for outdoor work where many kinds of airborne debris (berries, seeds, leaf particles, pine needles, feathers, etc.) fall into artists' equipment. Anything large can be brushed away. Whatever is small enough to fall through the support grid is cleaned out when the collection chamber is emptied.

When the case is closed and held in normal carrying position (FIG. 8-A), the upward location of outlet 42 prevents any escape of debris. To empty the collection chamber, the case is inverted, with handle 84 at the bottom, and agitated. The labyrinth of walls and gaps (FIG. 12-C) allow accumulated debris to be channeled toward and emptied through outlet 42.

Color capacity—FIG. 21

Most prior-art containers have a limited color capacity because their compartments are designed to hold full-length pastel sticks. Since artists prefer to work with pieces of pastels, rather than whole sticks, the pastel case holds and organizes partial lengths of pastels. FIG. 21 shows a color compartment holding pastels of different lengths and sizes. This allows the case to accommodate a greater number of colors in a given area. It also allows artists to restock colors that are running out, and keep the remaining small pieces in the compartment, or in the holding area, until they are finished.

Inventory—FIG. 22-A

Pastellists must constantly assess their inventory to maintain a complete color selection. Periodically, an artist will put pastels back into their assigned positions to determine which colors are running low or if any are missing. Checking and maintaining inventory is made easier by several aspects of the pastel case. The alignment elements save time getting pastels into their assigned positions, since only colors that have been moved need to be placed back in order. Refill area 119 (FIG. 22-A), as already noted, holds pieces of pastels that need to be replenished. A labeled color chart identifies colors determined to need restocking. Such colors can also be identified, listed, and ordered, as discussed below, by simulating the pastel case in a computer application's graphical user interface.

Computer cooperation—FIGS. 12-A, 25, and 28

Cooperative use with a computer is an aspect of the pastel case made possible by its integration of a labeling system with a unified array of assigned color positions. Color matching systems are used in the publishing industry to insure that images created in computer applications can be printed with predictable color fidelity. The pastel case's computer compatibility establishes a similar color matching system for painters and art students; one which insures that computer screen images can be painted with predictable color fidelity.

A typical option of computer paint and imaging programs is to allow the user to load a custom palette of specific colors. New images can be created, or existing images can be "remapped," using the colors of this custom palette. Thus the artist can work with images on a computer, always staying within a particular gamut or range of color. By loading a palette that has been calibrated to the colors in the pastel case, an image's colors can be kept exclusively within the case's color range. When the artist is satisfied with the design of an image, or wants to perform an exercise in a painting tutorial, these virtual pastel colors can be identified on screen, and their indexing information displayed. The case's indexed color chart then allows the artist to quickly and accurately select real pastel equivalents and output, or render, by hand an image that has been pre-visualized on the computer screen.

There are four steps essential to the case's cooperative use with a computer. First, a color arrangement of pastels must be established and indexed. Second, a pastel-calibrated palette must be created and loaded into a computer application. Third, an artist or student must interact with the computer application. Fourth, a result must be manually output in the pastel medium. Details of these steps are as follows:

1—Establish and index color arrangement

An established color arrangement is presented by the case's component color chart (FIG. 12-A). This display of pastel colors in assigned positions acts as a "color map." It operates similarly to the way in which computers, to reduce memory requirements, use "lookup tables" to assign colors to pixels on screen, or, in less technological terms, the way a paint-by-numbers kit works. By labeling each color card with transparent overlays (FIG. 25) the pastels in the case can be precisely indexed to their equivalent colors appearing on a computer screen.

2—Pastel-calibrated palette

A pastel-calibrated palette must be created in a graphics program, matching colors displayable on a computer monitor to each pastel in the case, and saved to disk. Such a palette, created by the artist, can be customized to his or her own selection of pastels, or alternatively, it can be supplied to the artist by the manufacturer of a specific line of pastels. When this palette is loaded into a computer application, the artist can revise works in progress, manipulate photo images, do electronic color studies, etc., always working within the "color space" of the case. The pastel-calibrated palette can be loaded into conventional paint and image-processing programs, or into computer-assisted painting programs and tutorials specifically created for use with the pastel case.

3—Interacting with computer

Artists interacting with computer applications can be best illustrated by specific examples. The following operational descriptions of programs useful to the artist, and art student, are provided to clarify some of the functions, capabilities, and advantages of using the case with a computer:

Analysis and compression of an image's colors are two of several computer techniques well suited for interactive use with the pastel case. Assume, for example, a selection of 216 pastel colors in the case, and that an equivalent pastel-calibrated palette has been loaded into an image-processing program on a computer. The artist can then load a scanned color photo or other image, and instruct the program to "remap" the image to this calibrated palette. The computer will then substitute, in the image, the pastel colors which come closest to the image's original colors. If the artist instructs the program to reduce the number of colors in the image to sixteen, the image will be compressed into a "posterized" (flat, simple areas of color) version, using those colors that best represent a sixteen-color interpretation of the original image. By causing the numerical data for each of these sixteen colors to be displayed, the artist can determine the pastel equivalents for the on-screen colors used in the image. The artist can then select the sixteen pastels and render this image traditionally (by hand).

Painting instruction is a second example of interactive use of the computer with the pastel case. Painting tutorials can be supplied by any number of sources including professional art teachers, workshop leaders, pastel manufacturers, or educational software publishers. The projects and tutorials are supplied on disk to, or downloaded online by, artists and hobbyists, who after viewing them on their computer screens are able, if the project requires, to print out an image's outline, scaled to whatever size is desired. The user then proceeds, after transferring this layout to high-quality paper, to apply pastel colors, guided by on-screen recommendations. The result can be either a simple color exercise, or a full-fledged painting, executed in traditional art materials, with permanent pigments.

This approach, while appearing to be painting by numbers, has far more instructive potential. Annotated, interactive lessons can be presented systematically alongside a step-by-step procedure, using sound and animation to introduce fundamental concepts of painting.

FIG. 28 shows, for example, an image field 187 depicting a simple demonstration of how to start a color study. The student has been asked first to put down the color note of a white block in shadow, by filling in area 208 with a specified color. The student is then guided, with text, to an understanding of how this first color note is the key to the rest of the painting (since every subsequent color note, such as cast shadow note 209, uses the first note as a point of reference). By following this demonstration, both on-screen and with pastel on paper, the student becomes familiar with working in the pastel medium, in an appropriate size, and is given an explanation of techniques that can be later employed in color study outdoors, under real lighting conditions.

Painting teachers can offer new students a disk of introductory color exercises to be performed with the pastel case. By becoming familiar with the fundamental concepts through these interactive tutorials, the student can come to a class or workshop better prepared, and ready to take full advantage of studying directly with the teacher.

4—Manual output

Successful manual output of color images, particularly by students, will depend on well-designed computer paint and instructional programs. While the case can be effectively used with existing computer graphics applications, the ideal format for a computer-assisted painting instruction program, for example, is to have an interface that mimics the case on screen. In FIG. 28, a computer screen shows the pastel case's color compartment arrangement being used as a color picker. Selecting the red-violet color family by clicking on color compartment button 182 of color picker 180 causes magnified Red-Violet color compartment 184 to appear at its right. This magnified compartment displays simulated pastel color elements representing red-violet colors for use in the painting or graphics program. A selected color 186 is shown in the magnified compartment; its selection is indicated by its raised appearance. Any other color in magnified compartment 184 can be selected by clicking on it. Alternatively, when the color picker is in "find" mode, a color may be selected directly from the image. The color clicked on in the image will then be displayed as a selected color in the magnified compartment, etc. In this way, pastel equivalents for specific colors in images can be quickly found. Since the on-screen pastels correspond directly to the artist's actual pastel colors, it is a simple matter to find these in the case, either in their assigned positions or by comparison with their color samples in the lid.

There is an advantage in using virtual pastels prior to manual output on paper. The pastel medium behaves poorly when subjected to excessive reworking because the paper painting surface gradually loses its ability to hold color after repeated application of pigment. The artist can, by trying out color combinations and compositions on the computer screen, overcome this limitation. Working on the design of an image in this way also permits the artist the luxury of experimentation free from concern about the cost of materials.

Inventory utility—FIG. 28

Checking and maintaining inventory can be made more convenient by using color picker 180 in "inventory" mode (FIG. 28). The artist can click on pastel color elements and retrieve price, catalog number, and ordering information on pastels that need to be replenished. Along with a pastel-calibrated palette, a manufacturer of pastels can supply the artist with such an inventory utility. Its accompanying database can also include relevant information on pigment composition, lightfastness, health hazards, etc. A list of colors the artist wishes to order can be compiled through this utility, and either sent printed out, faxed, or e-mailed to an appropriate supplier.

Conclusion, Ramifications, and Scope

Accordingly, the reader will see that my artist's pastel case and color arrangement is a quickly transportable device which keeps pastels clean and well-organized, and incorporates many needed features for artists working in the traditional manner of painting with pastels. In addition, its capacity to hold pastels in fixed relative positions allows its colors to be indexed for use in cooperation with computer paint and tutorial programs. Furthermore, the pastel case has the additional advantages in that

- its indexed color chart can be readily revised or modified by changing its component color cards and labels;
- its rectangular organization utilizes space efficiently to accommodate a large range of colors and ample, empty work areas;
- its easily visualized color arrangement makes managing pastels convenient; and
- its use as a numerically organized color kit allows a variety of color tutorials, projects, and demonstrations to be created and digitally transferred, offering hands-on painting experience and instruction to artists, art students, hobbyists, and home computer users.

Although the description above contains many specificities, these should not be construed as limiting the scope of the invention but as merely providing illustrations of some of the presently preferred embodiments of this invention. For example, the case's color compartments can vary in size and capacity; certain areas such as the holding areas need not have alignment elements, but can be floored with a simple, non-aligning mesh similar to that found in the current palette area; the support grid also need not be a mesh-like surface above a collection chamber, but simply a solid planar surface with alignment elements to keep oil pastels, children's crayons, or other similar types of non-debris producing coloring elements organized in place; the holding areas can run horizontally across the full width of the bottoms of the color compartments; the color chart can assume other forms, e.g., instead of an array of component color cards, it can be a single, flat chart held on the lid's interior surface, or an accordion-folded map kept separate from the case, etc.

Thus the scope of the invention should be determined by the appended claims and their legal equivalents, rather than by the examples given.

What is claimed is:

1. A palette or color arrangement comprising:

(a) a plurality of color areas disposed in a rectangular array for holding a plurality of coloring elements of a plurality of respective predetermined hues, said array being arranged in two rows, top and bottom, said coloring elements being arranged in the sequence of the visual spectrum, in a circuit around said rectangular array, and (b) an interval area, larger than any one of said plurality of color areas, disposed in one of said rows of said plurality of color areas and interrupting said sequence of the visual spectrum, whereby said interval area's incorporation into said circuit results in said plurality of color areas designated for holding coloring elements being disposed so that a color area in the middle of one of said rows can hold one of three primary colors, and two color areas at each end of the other of said rows can hold the two other primary colors.

2. The palette or color arrangement of claim 1 wherein said interval area is in said bottom row and said color area holding one of three primary colors is in the middle of said top row.

3. A device for holding pastels or similar artists' coloring materials, comprising:

(a) a case having a floor, (b) a support grid suspended a predetermined distance above said floor of said case, said support grid comprising two layers, top and bottom, of parallel elongated elements, the axes of said parallel elements of said top and bottom layers oriented substantially perpendicularly to one another, thus crisscrossing to form a mesh-like plane, and (c) said top layer of said support grid comprising a plurality of said parallel elements spaced apart at predetermined alternating intervals to form a surface of alternating narrow and wide, parallel channels, whereby said coloring materials can be kept aligned and compactly organized by being positioned upon said support grid so as to lie parallel to and on said wide channels, be slid along said wide channels of said support grid, and be restrained from rolling from side to side while resting upon said wide channels of said support grid, but dust and fragments fall through said support grid onto said floor of said case.

4. The device of claim 3, further including:

(a) a handle disposed on an exterior front wall of said case, and (b) a side wall having a debris outlet venting said floor of said case, said outlet disposed in an uppermost location on said side wall when said case is closed and held in normal carrying orientation by said handle, whereby leakage of said dust and fragments which have dropped to said floor of said case is prevented until said dust and fragments are intentionally emptied out of said case when said case is closed, inverted so that said handle and said outlet are oriented at the bottom, and deliberately agitated while tilted downward in the direction of said debris outlet.

5. A device for holding pastels or similar artists' coloring materials, comprising:

(a) a case which is substantially rectangular in shape (b) said case having a plurality of substantially rectangular color compartments, each of said color compartments for grouping a plurality of said coloring materials into a single color family, (c) a substantially flat support surface, horizontally disposed in said case, for underlying said groups of coloring materials within said color compartments, and (d) a multitude of parallel elongated elements within each of said color compartments, and disposed on said flat support surface, said elements being spaced apart at predetermined intervals to form within each of said color compartments a series of shallow, parallel tracks or channels on which said coloring materials may be compactly arranged, whereby an artist may more easily grasp a desired coloring material in any of said color families by adjustably sliding said coloring materials along said channels, and once said desired coloring material is picked up, neighboring coloring materials do not roll sideways into its place, so that said coloring materials, grouped in said color compartments, and resting on said channels, are kept in order and can be retained in their assigned relative positions within their respective color families unless intentionally moved or removed by said artist.

6. The device of claim 5, further including removable and storable means for exerting protective pressure on said coloring materials by which said coloring materials may be cushioned from shock and held in fixed positions while said case is transported, comprising:

(a) a lid for said case, said lid having interior and exterior surfaces, (b) a removable resilient liner or pad, having a lid-facing surface, said resilient liner nesting within said lid, and (c) a layer of material affixed to said lid-facing surface of said resilient pad, said layer of material providing fastening means cooperating in temporary attachment to said exterior surface of said lid by means of a plurality of surface areas providing compatible fastening means, whereby said resilient pad, when removed from said interior surface of said lid, may be secured onto said exterior surface of said lid.

7. A case for holding pastels or similar artists' coloring materials, comprising:

(a) a substantially flat horizontal support surface within said case, said support surface being divided or partitioned into a plurality of substantially rectangular color compartments, each of said color compartments for grouping a plurality of said coloring materials into a single color family, (b) a plurality of parallel elongated elements disposed on said support surface within each of said color compartments, said parallel elements being spaced apart at predetermined intervals to form within each of said color compartments a series of shallow, parallel tracks or channels on which said coloring materials may be compactly arranged, and (c) a subcompartment in which a plurality of said coloring materials may be temporarily placed, said subcompartment being smaller than, and disposed in an area within, each of said color compartments, whereby when a coloring material in one of said color compartments is chosen for use it may be distinguished as such by placing it in said subcompartment.

8. The case of claim 7, further including a plurality of parallel elongated elements disposed on said support surface within each of said smaller subcompartments, said parallel elements being spaced apart at predetermined intervals to form within each of said subcompartments a series of shallow, parallel tracks or channels on which said coloring materials may be placed, said parallel elements oriented in a direction substantially perpendicular to the plurality of parallel elongated elements disposed on said support surface within each of said color compartments, whereby when a coloring material in one of said color compartments is singled out for use and placed in a respective subcompartment it can be also further visually distinguished as such by its perpendicular orientation relative to the coloring materials arranged in said color compartment.

9. A method for cooperatively using pastels or similar artists' coloring materials with colors displayed on a computer screen by computer applications such as paint, graphics, and tutorial programs, or databases, comprising the steps of:

(a) organizing an indexed selection of said artists' coloring materials, and (b) calibrating a palette of on-screen colors, for use in one of said computer applications, to said indexed selection of said artists' coloring materials, and (c) loading said palette of on-screen colors into one of said computer applications so that a resulting image, color exercise, tutorial, or database function uses colors contained in said palette of on-screen colors, and (d) preparing to manually interact with said resulting image, color exercise, tutorial, or database function by having said computer application furnish index information for one or more displayed colors in said image, color exercise, tutorial, or database function, whereby colors corresponding to said displayed colors can be accessed by hand in said indexed selection of said artists' coloring materials, enabling an artist to recreate or interact with said resulting image, color exercise, tutorial, or database function displayed on said computer screen using traditional painting materials and methods.

10. A device for organizing, transporting, storing, and accessing pastels or similar artists' coloring elements, comprising:

(a) a case which is substantially rectangular in shape and tray-like, and having a floor, (b) a channeled support grid suspended in a plane parallel to, and at a predetermined distance above, said floor of said case, (c) a lid for said case, said lid having an interior surface, and an exterior surface, and (d) a removable resilient liner or pad, having a lid-facing surface, said resilient pad nesting within said lid, whereby said pastels may be held and kept arranged on said support grid when said case is opened, and protectively cushioned and fixed in position by being sandwiched in between said support grid and said resilient pad nesting within said lid when said lid is closed.

11. The device of claim 10, further including a color chart disposed on said interior surface of said lid, said color chart comprising:

(a) a plurality of color card holders disposed on said interior surface of said lid, and (b) a plurality of color cards in said color card holders, said cards indicating the preferred arrangement of said pastels held in said case, whereby assigned positions of pastels are determined within said case, in accordance with a predetermined and preferred arrangement of said pastels, and said assigned positions are displayed by means of said color cards in said lid, and can be viewed by removing said resilient pad.

12. The device of claim 11, further including a plurality of corresponding transparent overlays which may be placed over said respective color cards, whereby printed information related to each underlying assigned position indicated on said color cards may be superposed directly over, or immediately adjacent to said assigned position.

13. The device of claim 10, further including a plurality of partitioning elements which divide a portion of the area of said case into rows of color compartments, in which a series of main color compartments are respectively designated for holding pastels belonging to a color family corresponding to a hue classification indicated on a painter's color triangle, and disposed in locations so that one of said main color compartments, designated for holding one of the three primaries, is always in the middle of a top row, and two other of said main color compartments, designated for holding the other two primaries, are always in a lower row at the far left, and at the far right, whereby the twelve hue classifications and the positions of the three primaries at the vertices of said painter's color triangle are transformed into a rectangular arrangement of color compartments.

14. The device of claim 13 wherein each of said main color compartments is configured in a predetermined size for holding partial lengths of said pastels, rather than whole sticks, whereby said case can manage and present a comprehensive range of different colors organized within a single tray.

15. The device of claim 13, further including a plurality of partitioning elements which create a current palette area within a portion of the area of said case, said current palette area comprising:

(a) an area substantially larger than any one of said compartments in said case, and (b) said support grid constructed of interwoven elements forming a conventional mesh screen which does not align said pastels, but having a bumpy surface for preventing said pastels from freely rolling about, whereby an artist has ample work space in which to place said pastels in current use, and in which said pastels in use may remain during transport, thus allowing this selected grouping of said pastels to be saved for later use.

16. The device of claim 13, further including a plurality of partitioning elements which create a refill area within a portion of the area of said case, said refill area comprising:

(a) an area, substantially smaller than any of said compartments in said case, and (b) a fine-mesh screen floor overlying said support grid within said refill area, which supports very small pastel particles that would normally fall through said support grid in other parts of said case, whereby fragments of pastels which need to be replenished may be safely held.

17. The device of claim 10 wherein said lid is detachable from said case, whereby said case may be used in situations where said lid is an encumbrance.

18. The device of claim 17, further including a plurality of nesting brackets underneath said case which engage said resilient pad when it is positioned underneath said case, whereby said resilient pad, when it is removed from said lid, can be protectively stored underneath said case, and whereby said resilient pad can be similarly engaged, when it remains attached to said lid, thus allowing said lid when detached from said case to be stored underneath said case.

19. The device of claim 10, further including a layer of material affixed to said lid-facing surface of said resilient pad, said layer of material providing fastening means cooperating in temporary attachment to said exterior surface of said lid by means of a plurality of surface areas providing compatible fastening means, said surface areas bordered by a plurality of nesting brackets on said exterior surface of said lid, whereby said resilient pad, removed from said interior surface of said lid, may be secured onto said exterior surface of said lid within said nesting brackets.

20. The device of claim 10, further including a plurality of anchor bars and attachment slots which are integrated with a plurality of bottom edges of said case, whereby said case can be securely mounted onto a variety of easels, tripods, or work surfaces.

* * * * *